US009051148B2

(12) United States Patent
Ishizuka

(10) Patent No.: US 9,051,148 B2
(45) Date of Patent: Jun. 9, 2015

(54) IMAGE PROCESSING APPARATUS, INFORMATION PROCESSING APPARATUS, AND CONTROL METHOD

(71) Applicant: CANON KABUSHIKI KAISHA, Tokyo (JP)

(72) Inventor: Koichi Ishizuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/928,134

(22) Filed: Jun. 26, 2013

(65) Prior Publication Data

US 2014/0001693 A1 Jan. 2, 2014

(30) Foreign Application Priority Data

Jun. 28, 2012 (JP) ..... 2012-145658

(51) Int. Cl.

*B65H 37/04* (2006.01)
*B31F 1/07* (2006.01)
*B31F 5/02* (2006.01)

(52) U.S. Cl.

CPC . *B65H 37/04* (2013.01); *B31F 1/07* (2013.01); *B31F 5/02* (2013.01); *B65H 2301/51616* (2013.01); *B65H 2801/27* (2013.01)

(58) Field of Classification Search

CPC ..... B65H 37/04; B65H 2301/51616; B65H 2801/27; B31F 1/07; B31F 5/02
USPC ..... 270/58.07, 58.08
See application file for complete search history.

(56) References Cited

U.S. PATENT DOCUMENTS

| | | | | |
|---|---|---|---|---|
| 7,413,177 | B2 * | 8/2008 | Mori et al. | 270/58.09 |
| 8,444,133 | B2 * | 5/2013 | Kimura | 270/58.08 |
| 2011/0135366 | A1 * | 6/2011 | Asai et al. | 399/408 |
| 2011/0304090 | A1 * | 12/2011 | Kimura | 270/58.11 |
| 2013/0214470 | A1 * | 8/2013 | Yokomizo | 270/1.01 |

FOREIGN PATENT DOCUMENTS

JP 08-300847 A 11/1996

* cited by examiner

*Primary Examiner* — Leslie A Nicholson, III
(74) *Attorney, Agent, or Firm* — Canon USA, Inc., I.P. Division

(57) ABSTRACT

An image processing apparatus prints an image on a sheet and controls one of a plurality of binding units to bind the sheets on which the images are printed. The image processing apparatus further enables designation of a binding process to be used to bind the sheets, and provides notification of the number of sheets that can be bound by the designated binding process and the number of sheets that can be bound by a non-designated binding process.

16 Claims, 28 Drawing Sheets

FIG.13

■ COPY
<PAGE AGGREGATE>
SET NUMBER OF PAGES TO ALLOCATE TO A SHEET.

2 in 1 | 4 in 1 | 8 in 1

× CANCEL SETTING | OK

FIG.17

| SHEET SIZE | SHEET TYPE | TYPE OF BINGING PROCESSING | |
|---|---|---|---|
| | | FIRST BINDING PROCESSING | SECOND BINDING PROCESSING |
| A3 | PLAIN PAPER | 38 | 11 |
| | THICK PAPER 1 | 34 | 9 |
| | THICK PAPER 2 | 30 | 7 |
| B4 | PLAIN PAPER | 42 | 12 |
| | THICK PAPER 1 | 38 | 10 |
| | THICK PAPER 2 | 34 | 8 |
| A4 | PLAIN PAPER | 46 | 13 |
| | THICK PAPER 1 | 42 | 11 |
| | THICK PAPER 2 | 38 | 9 |
| B5 | PLAIN PAPER | 50 | 14 |
| | THICK PAPER 1 | 46 | 12 |
| | THICK PAPER 2 | 42 | 10 |

FIG.18

| SHEET FEEDING UNIT | SHEET SIZE | SHEET TYPE |
|---|---|---|
| CASSETTE 1 | A4 | THICK PAPER 2 |
| CASSETTE 2 | A4 | THICK PAPER 1 |
| CASSETTE 3 | A3 | THICK PAPER 1 |
| UPPER DECK | A3 | PLAIN PAPER |
| MIDDLE DECK | A4 | PLAIN PAPER |
| LOWER DECK | B5 | PLAIN PAPER |

FIG.20

| TYPE OF TWO-SIDED COPYING | PAGE AGGREGATE | NUMBER OF DOCUMENTS PER SHEET |
|---|---|---|
| ONE-SIDED TO ONE-SIDED | NONE | 1 |
| | 2 PAGES PER SHEET | 2 |
| | 4 PAGES PER SHEET | 4 |
| | 8 PAGES PER SHEET | 8 |
| ONE-SIDED TO TWO-SIDED | NONE | 2 |
| | 2 PAGES PER SHEET | 4 |
| | 4 PAGES PER SHEET | 8 |
| | 8 PAGES PER SHEET | 16 |
| TWO-SIDED TO TWO-SIDED | NONE | 1 |
| | 2 PAGES PER SHEET | 2 |
| | 4 PAGES PER SHEET | 4 |
| | 8 PAGES PER SHEET | 8 |
| TWO-SIDED TO ONE-SIDED | NONE | 0.5 |
| | 2 PAGES PER SHEET | 1 |
| | 4 PAGES PER SHEET | 2 |
| | 8 PAGES PER SHEET | 4 |

IMAGE PROCESSING APPARATUS, INFORMATION PROCESSING APPARATUS, AND CONTROL METHOD

BACKGROUND

1. Field of the Disclosure

Aspects of the present invention generally relate to an image processing apparatus which prints images on sheets and controls a binding unit to bind the sheets. The present disclosure also relates to an information processing apparatus which transmits print data to the image processing apparatus.

2. Description of the Related Art

There is an image processing apparatus that prints images on sheets and controls a sheet processing apparatus to bind a plurality of printed sheets. Representative examples of binding processes include staple binding. The staple binding process binds a plurality of sheets by using a metal staple or staples.

Among methods for binding a plurality of sheets without staples is one that includes punching out a set of a plurality of sheets together and weaving each tip of strips back through (Japanese Patent Application Laid-Open No. 08-300847). Other methods include one for pasting a plurality of sheets with glue and one for pressing a special blade against a plurality of sheets to squeeze the plurality of sheets together.

As compared to the binding processing for binding a plurality of sheets with staples, the binding processing for binding a plurality of sheets without staples has low binding force and the maximum number of sheets that can be bound is smaller. On the other hand, the binding processing for binding sheets without staples has the advantages that the nonuse of staples saves resources, and the print product can be discarded without removal of staples. A user uses the binding process for binding sheets with staples or the binding process for binding sheets without staples according to the intended application.

Since the maximum number of sheets that can be bound by the binding process for binding sheets with staples and the binding process for binding sheets without staples are different, the user may erroneously use an incorrect binding process. For example, when the user makes a copy of a plurality of documents, the number of sheets to be printed may exceed the maximum number of sheets that can be bound by the binding process designated by the user and the binding process may fail to be performed, depending on the number of documents and copy settings.

SUMMARY

According to an aspect of the present invention, an image processing apparatus capable of printing an image on a sheet and controlling one of a plurality of binding units to bind the sheets, the plurality of binding units being configured to perform a respective plurality of types of binding processes, includes a printing unit configured to print an image on a sheet, a control unit configured to control one of the plurality of binding units to bind sheets on which images are printed by the printing unit, a designation unit configured to enable designation of a binding process to be used to bind the sheets, and a notification unit configured to provide notification of the number of sheets that can be bound by the designated binding process and the number of sheets that can be bound by a non-designated binding process.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 13 is a diagram illustrating an example of a user interface screen for making a page aggregate setting.

FIG. 17 is a diagram illustrating an example of a table used to calculate the maximum number of sheets.

FIG. 18 is a diagram illustrating an example of a table listing sizes and types of sheets stored in respective sheet feeding units.

FIG. 20 is a diagram illustrating an example of a table used to calculate the maximum number of documents.

DESCRIPTION OF THE EMBODIMENTS

Various exemplary embodiments, features, and aspects of the invention will be described in detail below with reference to the drawings.

Figure 1:
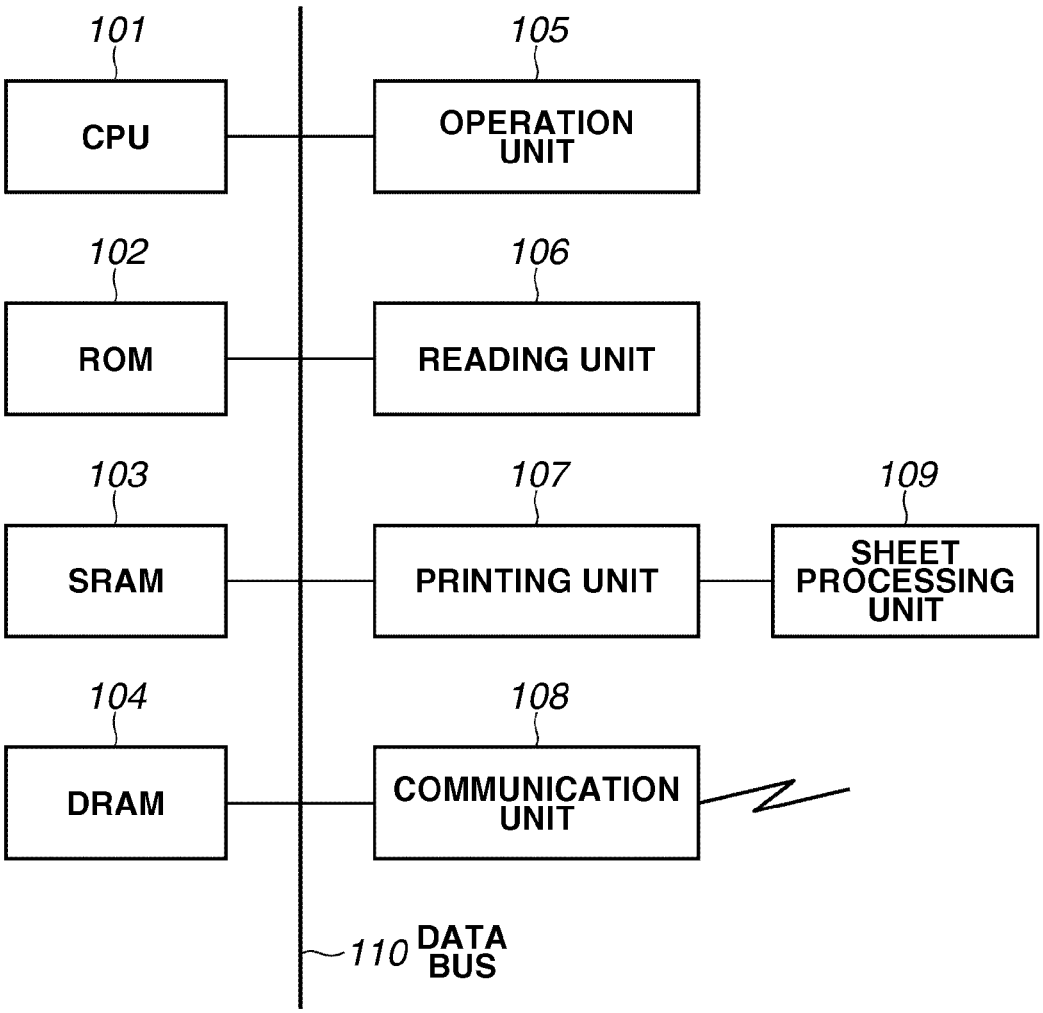
FIG. 1 is a block diagram illustrating a configuration of an image processing apparatus according to an exemplary embodiment.

FIG. 1 is a block diagram illustrating a configuration of an image processing apparatus according to an exemplary embodiment. The image processing apparatus has a reading function of reading an image on a sheet and a printing function of printing an image on a sheet. A sheet processing apparatus is connected to the image processing apparatus. The sheet processing apparatus has a post-processing function of binding and/or folding a sheet or sheets. FIG. 1 illustrates an example where the image processing apparatus includes a sheet processing unit serving as the sheet processing apparatus. Note that the sheet processing apparatus may be detachably attached to the image processing apparatus. Examples of the sheets include a sheet of plain paper, a sheet of thick paper, and an overhead projector (OHP) sheet.

A central processing unit (CPU) 101 is a control unit of the image processing apparatus. The CPU 101 executes a program to control the entire image processing apparatus. A read-only memory (ROM) 102 stores a control program executable by the CPU 101. A static random access memory (SRAM) 103 stores setting values registered by a user and management data of the image processing apparatus, and functions as a working buffer of the CPU 101. The SRAM 103 is a nonvolatile memory and can be driven by a battery. Information stored in the SRAM 103 will not disappear even when the image processing apparatus is powered off. A dynamic random access memory (DRAM) 104 stores control variables of the program executed by the CPU 101. Depending on the type of the image processing apparatus, a hard disk drive (HDD) may be used instead of the SRAM 103.

An operation unit 105 displays information to the user and inputs an instruction from the user. For such purposes, the operation unit 105 includes a touch panel display which displays user interface screens to be described below, and a start button. The operation unit 105 may include a display monitor and various hardware keys instead of the touch panel display.

A reading unit 106 reads an image on a sheet and converts the image into image data such as binary data. The image data generated by the reading unit 106 is stored into the SRAM 103. The image data is subsequently transmitted to an external apparatus and/or printed on a sheet. A printing unit 107 prints an image based on image data onto a sheet. For copying, the reading unit 106 reads an image on a sheet to generate image data, and the printing unit 107 prints an image based on the image data onto a sheet.

A communication unit 108 transmits image data to an external apparatus and/or receives image data from an external apparatus. The communication unit 108 communicates with an external computer via a network such as a wired local area network (LAN) and a wireless LAN, communicates with an external computer via a local interface such as a Universal Serial Bus (USB), and/or communicates with an external facsimile apparatus via a telephone line. The image data received by the communication unit 108 is stored into the SRAM 103.

A data bus 110 transfers image data and communication signals between various devices.

The printing unit 107 is connected to the sheet processing unit 109, and conveys a printed sheet or sheets to a sheet processing unit 109. The sheet processing unit 109 receives a control command from the CPU 101 via the printing unit 107, and applies post-processing to the sheet(s) according to the control command. For example, the sheet processing unit 109 aligns a plurality of sheets, distributes a plurality of sheets between a plurality of trays, and/or binds a plurality of sheets. In the present exemplary embodiment, the sheet processing unit 109 can perform at least either first binding processing for stapling a plurality of sheets or second binding processing for binding a plurality of sheets without staples.

Figure 2:
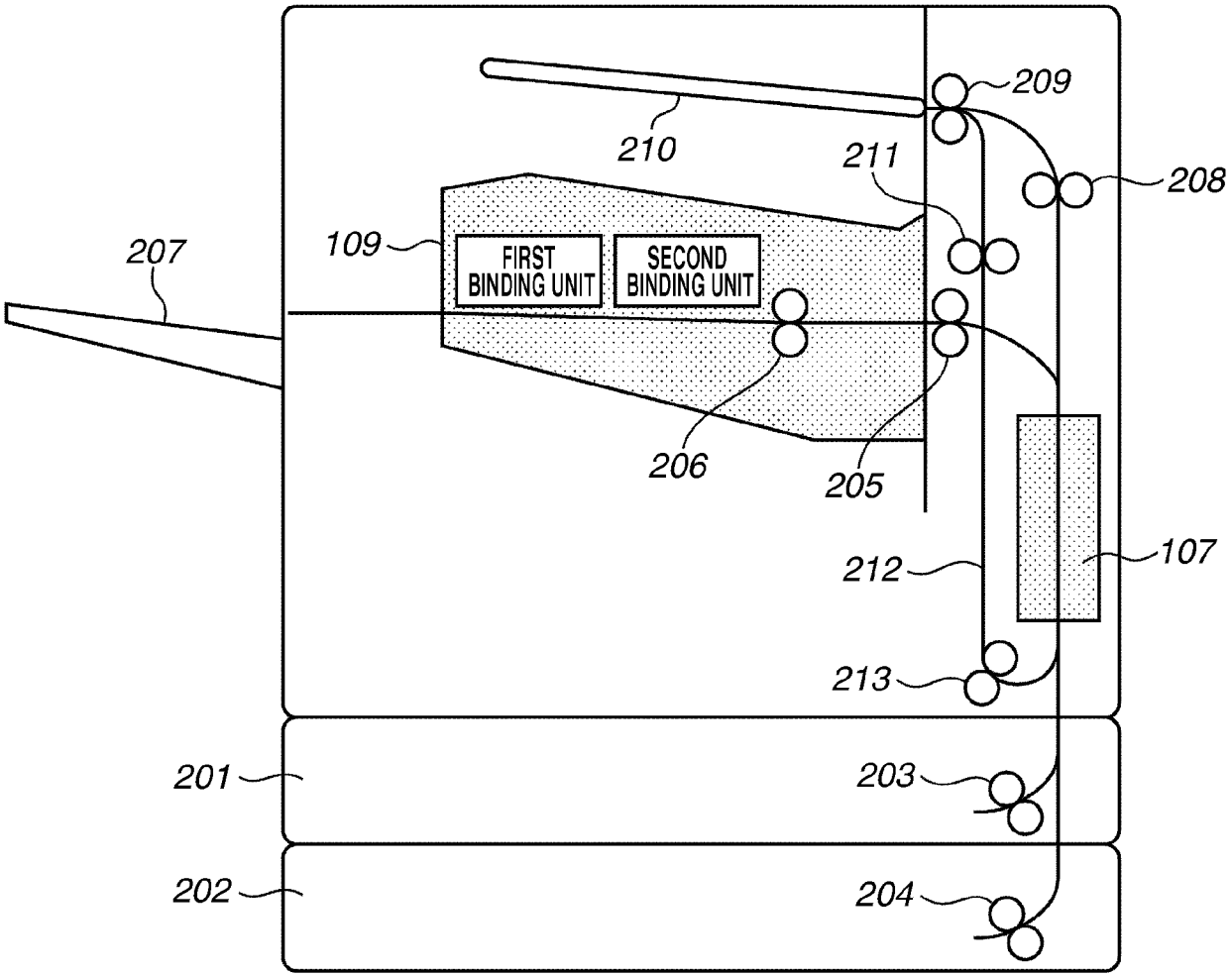
FIG. 2 is a sectional view of the image processing apparatus.

FIG. 2 is a sectional view of the image processing apparatus. In FIG. 2, a description of the CPU 101, the ROM 102, the SRAM 103, the DRAM 104, the operation unit 105, the reading unit 106, and the communication unit 108 will be omitted.

In FIG. 2, the sheet processing unit 109 is arranged inside a housing of the image processing apparatus. Note that the arrangement of the sheet processing unit 109 is not limited to the example of FIG. 2. The sheet processing unit 109 may be connected next to the image processing apparatus.

Sheet feeding units 201 and 202 each store sheets. While in FIG. 2 the image processing apparatus includes two sheet feeding units, the number of sheet feeding units is not limited to two. Conveyance rollers 203 convey a sheet stored in the sheet feeding unit 201 to the printing unit 107. Conveyance rollers 204 convey a sheet stored in the sheet feeding unit 202 to the printing unit 107. The printing unit 107 prints an image on a first side of the conveyed sheet. The printing unit 107 may employ either an inkjet method for printing an image by discharging ink at a sheet or an electrophotographic method for printing an image by fixing toner onto a sheet.

In the case of one-sided printing, the printed sheet is guided to conveyance rollers 205. The conveyance rollers 205 convey the sheet to the sheet processing unit 109. Conveyance rollers 206 covey the sheet to a first binding unit or a second binding unit.

In FIG. 2, the sheet processing unit 109 includes two juxtaposed binding units. The first binding unit is called stapler, and binds a plurality of sheets with a metal staple or staples. The second binding unit binds a plurality of sheets without staples. The second binding unit will be described in detail below. For binding processing, a plurality of sheets is conveyed to the sheet processing unit 109 one by one. The sheet processing unit 109 retains the plurality of sheets, and the first binding unit or the second binding unit binds the plurality of retained sheets. In FIG. 2, the sheet processing unit 109 includes the first and second binding units, whereas the sheet processing unit 109 may include only the second binding unit.

The sheets are passed through the sheet processing unit 109 before discharged to a sheet discharge unit 207.

In the case of two-sided printing, the printed sheet is guided to conveyance rollers 208. The conveyance rollers 208 convey the sheet to conveyance rollers 209. The conveyance rollers 209 convey the sheet to a reversing path 210. When a trailing edge of the sheet reaches the conveyance rollers 209, the conveyance rollers 209 start a reverse rotation to convey the sheet to conveyance rollers 211. The conveyance rollers 211 convey the sheet to conveyance rollers 213 through a two-sided printing conveyance path 212. The conveyance rollers 213 convey the sheet to the printing unit 107. The printing unit 107 prints an image on a second side of the sheet. The sheet printed on both sides is guided to the conveyance rollers 205. The conveyance rollers 205 convey the sheet to the sheet processing unit 109.

Figure 28:
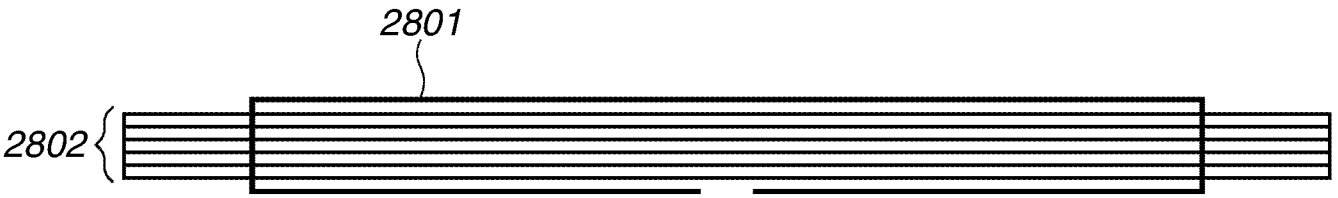
FIG. 28 is a diagram illustrating a first binding process performed by a first binding unit.

FIG. 28 is a diagram illustrating the first binding processing performed by the first binding unit. The first binding processing is conventionally known staple processing. In the first binding processing, the first binding unit drives a staple 2801 through a plurality of sheets 2802 to bind the plurality of sheets 2802.

Figures 3A, 3B:
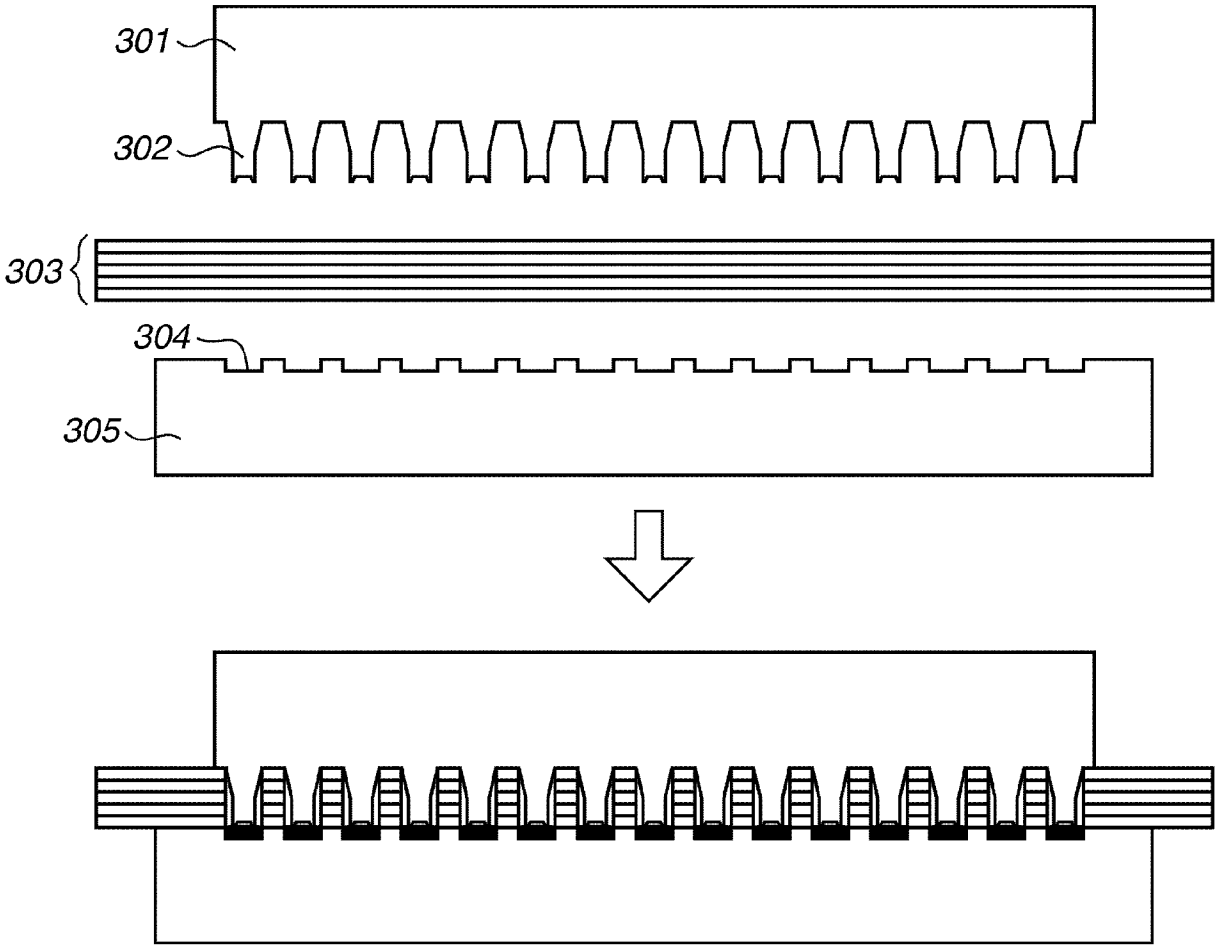
FIGS. 3A and 3B are diagrams illustrating a second binding process performed by a second binding unit.

FIGS. 3A and 3B are diagrams illustrating the second staple processing performed by the second binding unit. In the second binding processing, the second binding unit applies pressure to a plurality of sheets from above and from below to bring the plurality of sheets into close contact for binding. FIG. 3A illustrates a state where a plurality of sheets 303 is set in a binding position and the second binding unit is moved to the binding position.

An upper mold 301 presses the plurality of sheets 303 from above. The upper mold 301 includes a plurality of protruding blades 302 arranged in a row. The blades 302 each apply pressure to the sheets 303. A lower mold 305 presses the plurality of sheets 303 from below. The lower mold 305 includes a row of a plurality of recesses 304 corresponding to the plurality of blades 302. The recesses 304 receive the respective blades 302.

FIG. 3B illustrates a state where the upper mold 301 and the lower mold 305 press the plurality of sheets 303 in a vertical direction. The upper mold 301 and the lower mold 305 can press the plurality of sheets 303 to bind the plurality of sheets 303. The plurality of blades 302 and the plurality of recessed 304 press the sheets 303 in a plurality of places to make the sheets 303 less likely to exfoliate.

Figure 4:
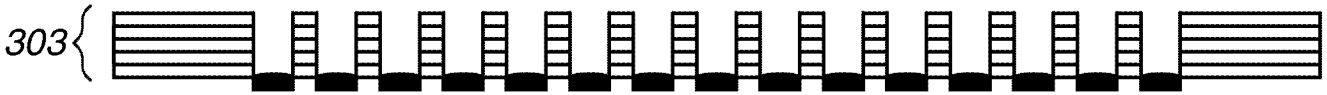
FIG. 4 is a diagram illustrating a cross section of a plurality of bound sheets.

FIG. 4 is a diagram illustrating a cross section of the plurality of bound sheets 303.

Figure 5:
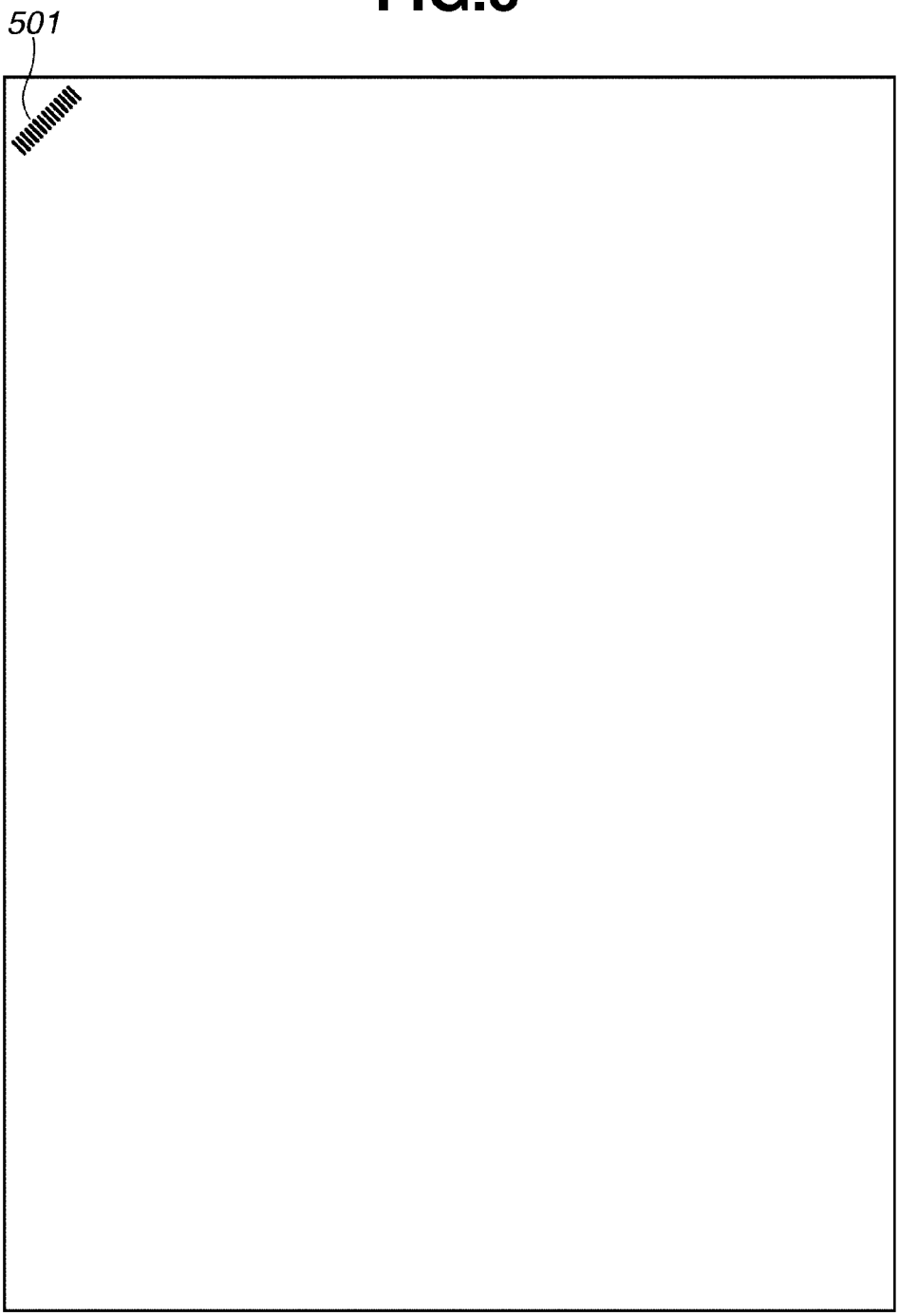
FIG. 5 is a diagram illustrating the plurality of bound sheets as seen from above.

FIG. 5 is a diagram illustrating the plurality of bound sheets 303 as seen from above. The plurality of sheets 303 is pressed and deformed by the blades 302 and the recesses 304 in a binding position 501. Since the second binding processing binds a plurality of sheets by pressing, the number of sheets that can be bound by the second binding processing is smaller than the number of sheets that can be bound by the first binding processing.

If the image processing apparatus is capable of performing both the first binding processing and the second binding processing, the user can select which binding processing to be performed.

Figure 6:
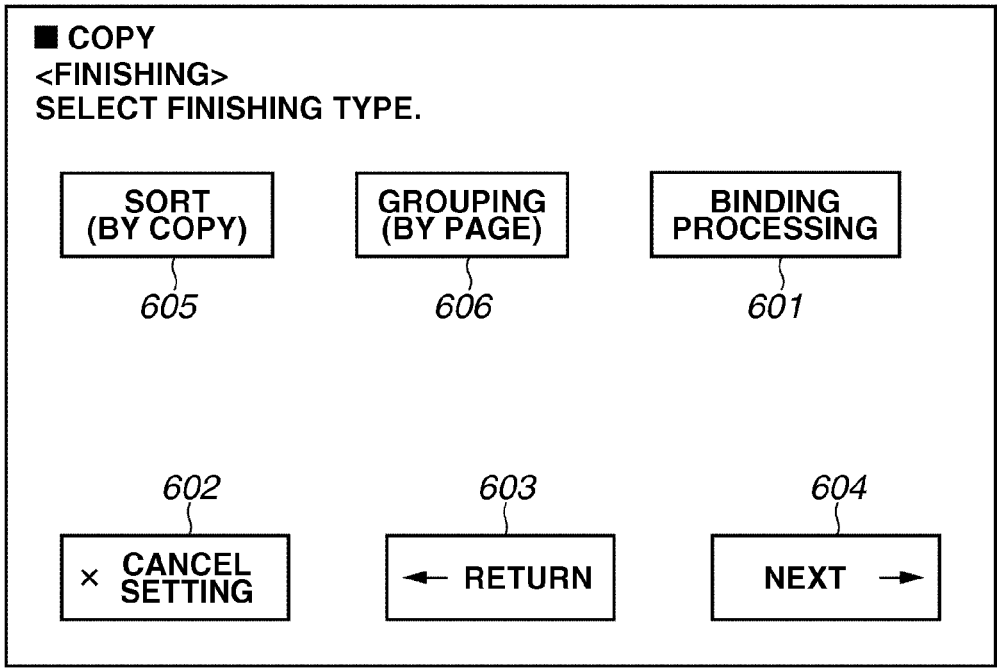
FIG. 6 is a diagram illustrating an example of a user interface screen displayed on an operation unit.

FIG. 6 is a diagram illustrating an example of a user interface screen displayed on the operation unit 105. On the user interface screen of FIG. 6, the user makes settings about copy finishing. If the image processing apparatus is capable of performing both the first binding processing and the second binding processing, the user presses a key 601 to display a user interface screen for selecting a type of binding processing on the operation unit 105.

Figure 7:
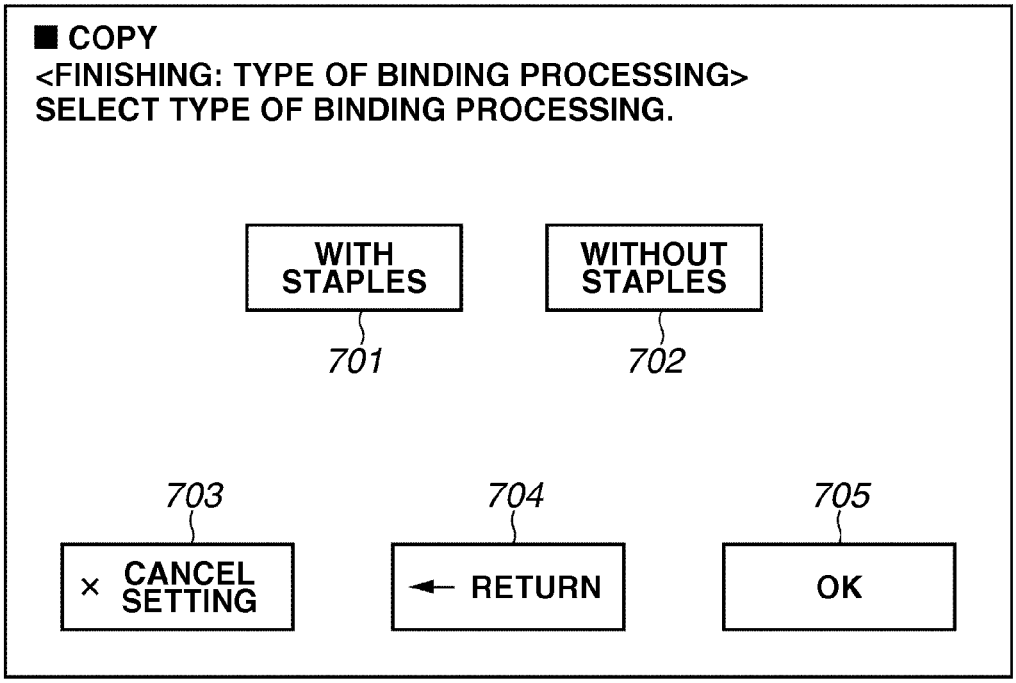
FIG. 7 is a diagram illustrating an example of a user interface screen for selecting a type of binding process.

FIG. 7 is a diagram illustrating an example of the user interface screen for selecting the type of binding processing. A key 701 is intended to select the first binding processing. A key 702 is intended to select the second binding processing.

Figure 8:
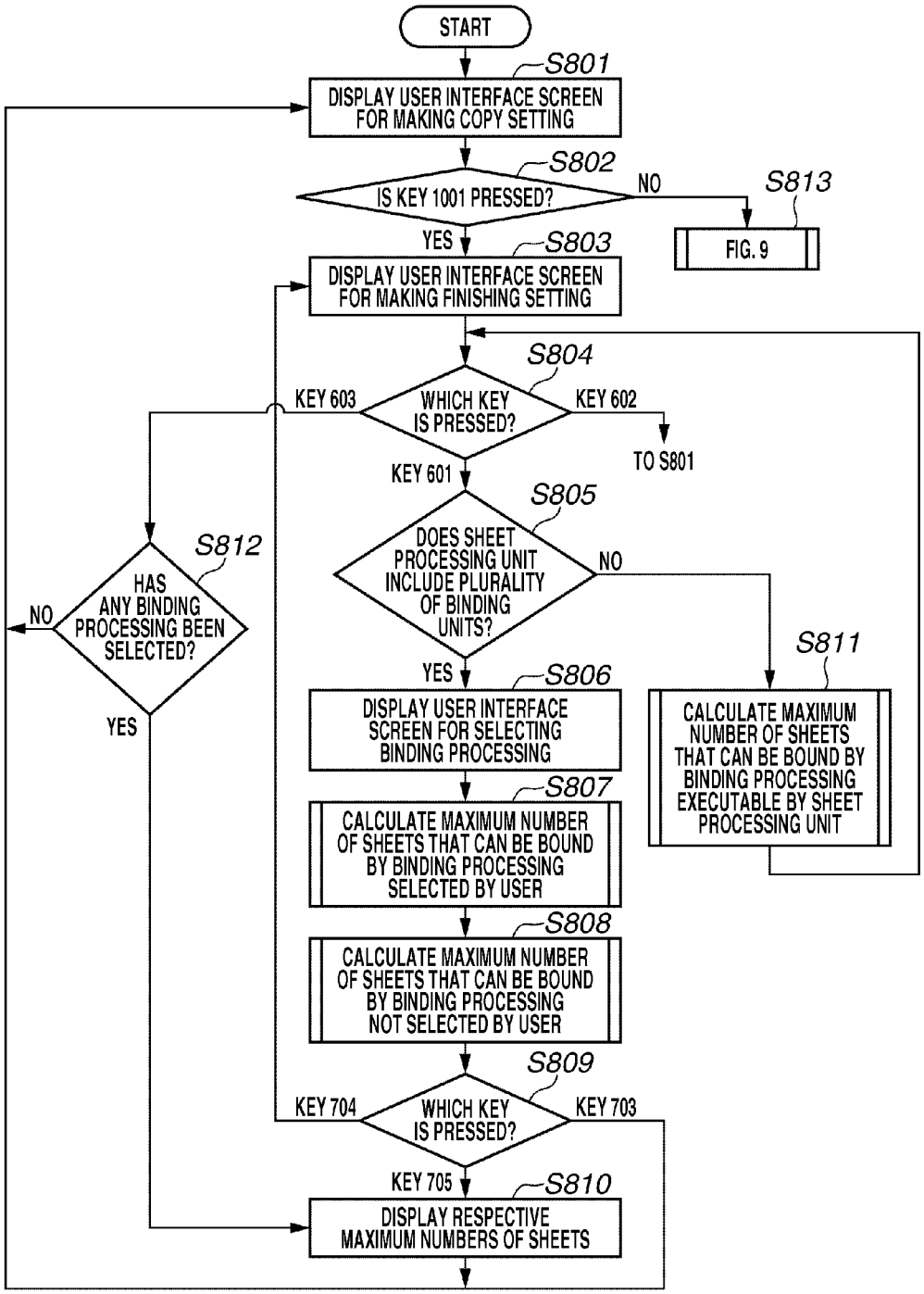
FIG. 8 is a flowchart illustrating a control method for controlling execution of copying.
Figure 9:
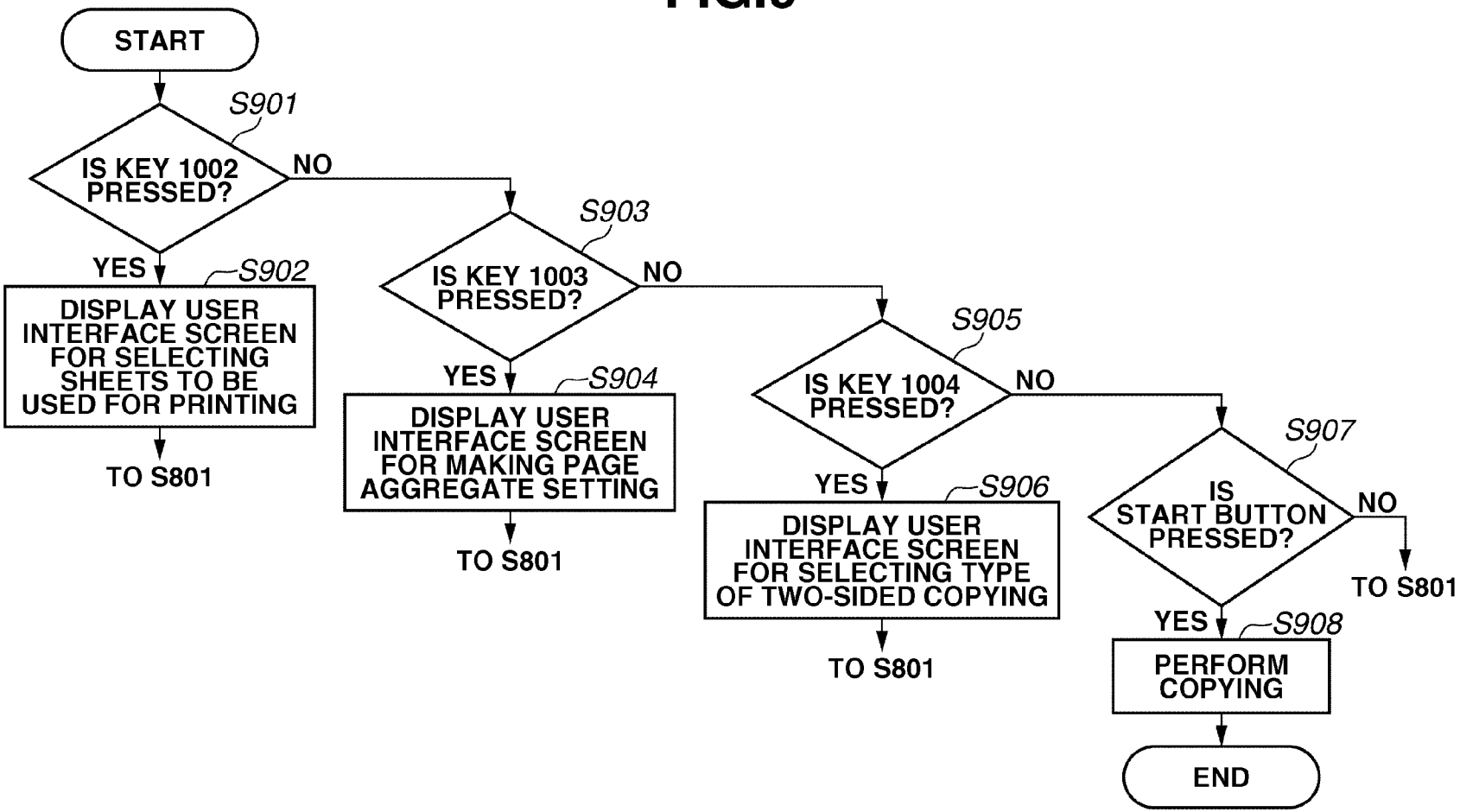
FIG. 9 is a flowchart illustrating the control method for controlling the execution of copying.
Figure 15:
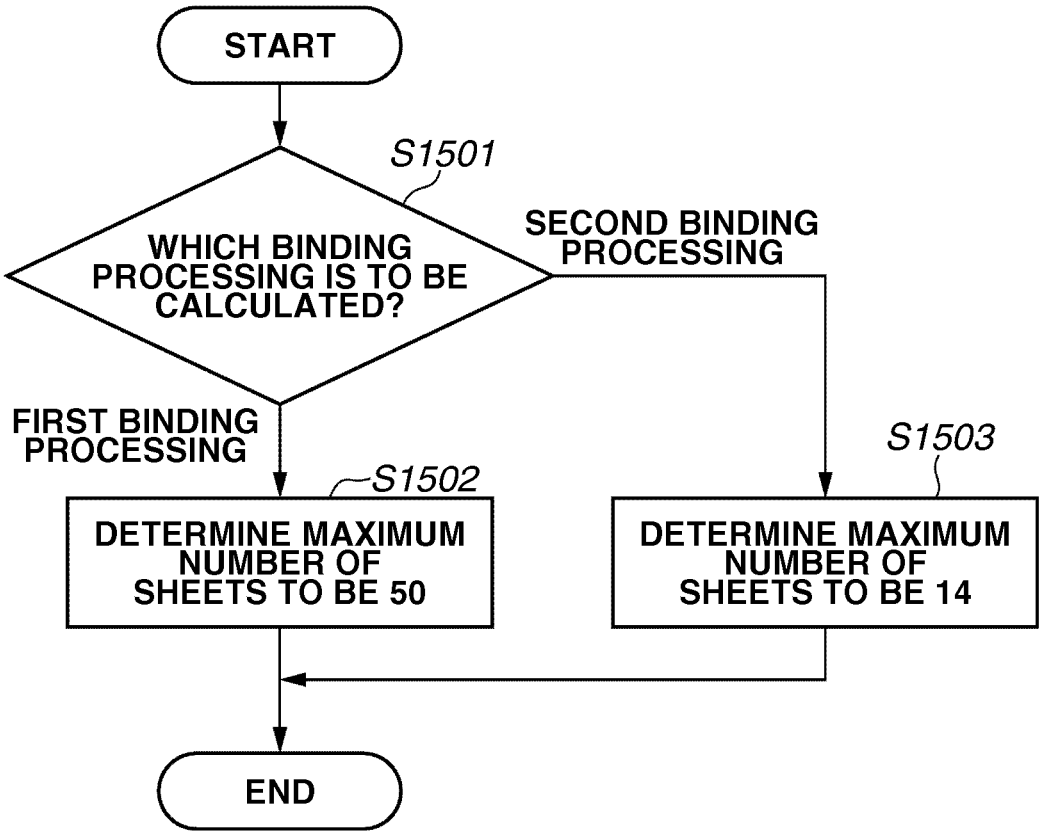
FIG. 15 is a diagram illustrating a flowchart of calculation processing for calculating the maximum number of sheets.

FIGS. 8, 9, and 15 are flowcharts illustrating a control method for controlling execution of copying. The CPU 101 executes a control program based on the flowcharts to implement the control method.

When the user selects copying on a main screen displayed on the operation unit 105, the CPU 101 executes this control program. In step S801, the CPU 101 initially controls the operation unit 105 to display a user interface screen for making a copy setting.

Figure 10:
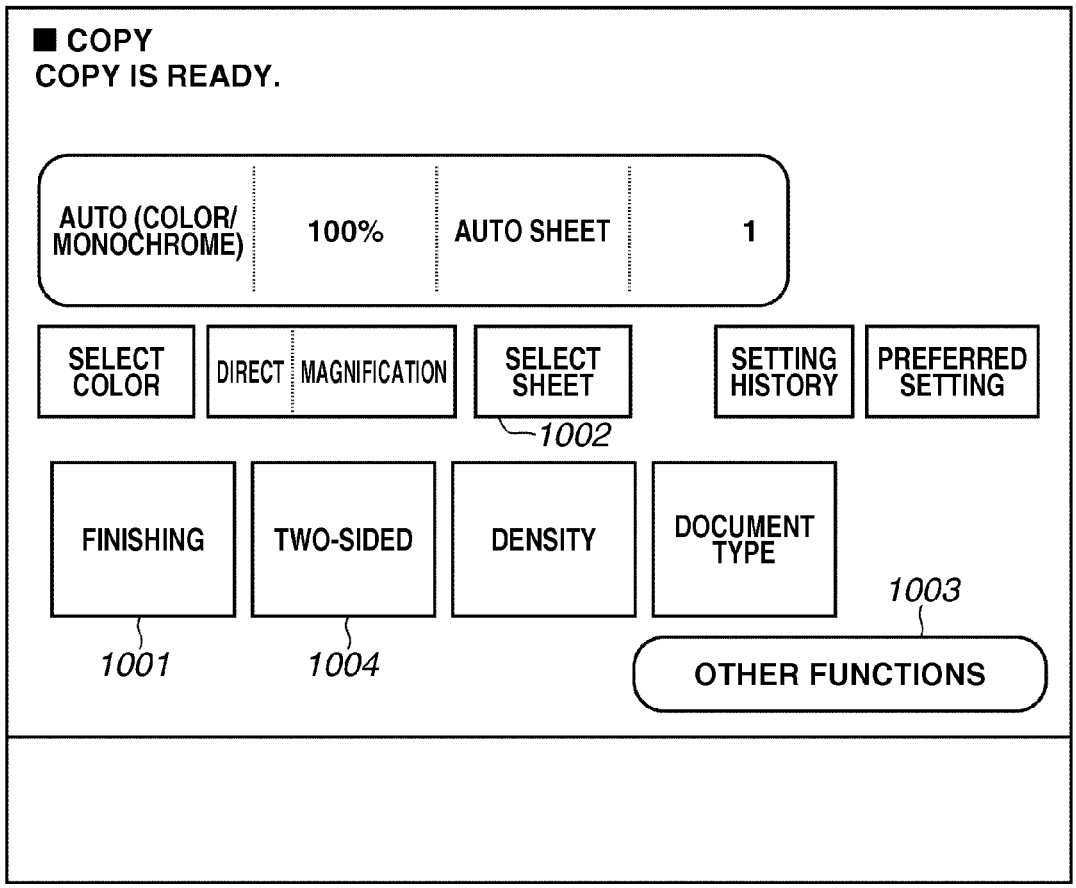
FIG. 10 is a diagram illustrating an example of a user interface screen for making a copy setting.

FIG. 10 is a diagram illustrating an example of the user interface screen displayed in step S801. On the user interface screen of FIG. 10, the user can select color copy or monochrome copy, set a copy magnification, select a type of sheets to be used for printing, and select a type of two-sided copying. To make a finishing setting, the user presses a key 1001.

In step S802, the CPU 101 determines whether the key 1001 is pressed on the user interface screen of FIG. 10. If the key 1001 is not pressed (NO in step S802), then in step S813, the CPU 101 proceeds to the flowchart of FIG. 9.

If the key 1001 is pressed (YES in step S802), then in step S803, the CPU 101 controls the operation unit 105 to display the user interface screen illustrated in FIG. 6. In step S804, the CPU 101 determines which of the keys 601 to 603 is pressed on the user interface screen of FIG. 6. A key 604 is intended to set a binding position. Keys 605 and 606 are intended to select finishing processing other than the binding processing. In FIG. 8, a description of control when the keys 604 to 606 are pressed is omitted.

If the key 601 is pressed (KEY 601 in step S804), then in step S805, the CPU 101 determines whether the sheet processing unit 109 includes a plurality of types of binding units. If the sheet processing unit 109 includes a plurality of types of binding units, i.e., the first binding unit and the second binding unit (YES in step S805), then in step S806, the CPU 101 controls the operation unit 105 to display the user interface screen of FIG. 7. If the user selects either the first binding processing or the second binding processing on the user interface screen of FIG. 7, then in step S807, the CPU 101 calculates the maximum number of sheets that can be bound by the binding processing selected by the user. In step S808, the CPU 101 further calculates the maximum number of sheets that can be bound by the binding processing not selected by the user. Calculation methods in steps S807 and 808 will be described below.

In step S809, the CPU 101 determines which of keys 703 to 705 is pressed on the user interface screen of FIG. 7. If the key 703 is pressed (KEY 703 in step S809), the CPU 101 returns to step S801 without making a finishing setting. If the key 704 is pressed (KEY 704 in step S809), the CPU 101 stores the contents set or selected by the user into the SRAM 103 as setting values, and returns to step S803. If the key 705 is pressed (KEY 705 in step S809), then in step S810, the CPU 101 stores the contents set or selected by the user into the SRAM 103 as setting values, and controls the operation unit 105 to display the maximum numbers of sheets calculated in steps S807 and S808.

Figure 11:
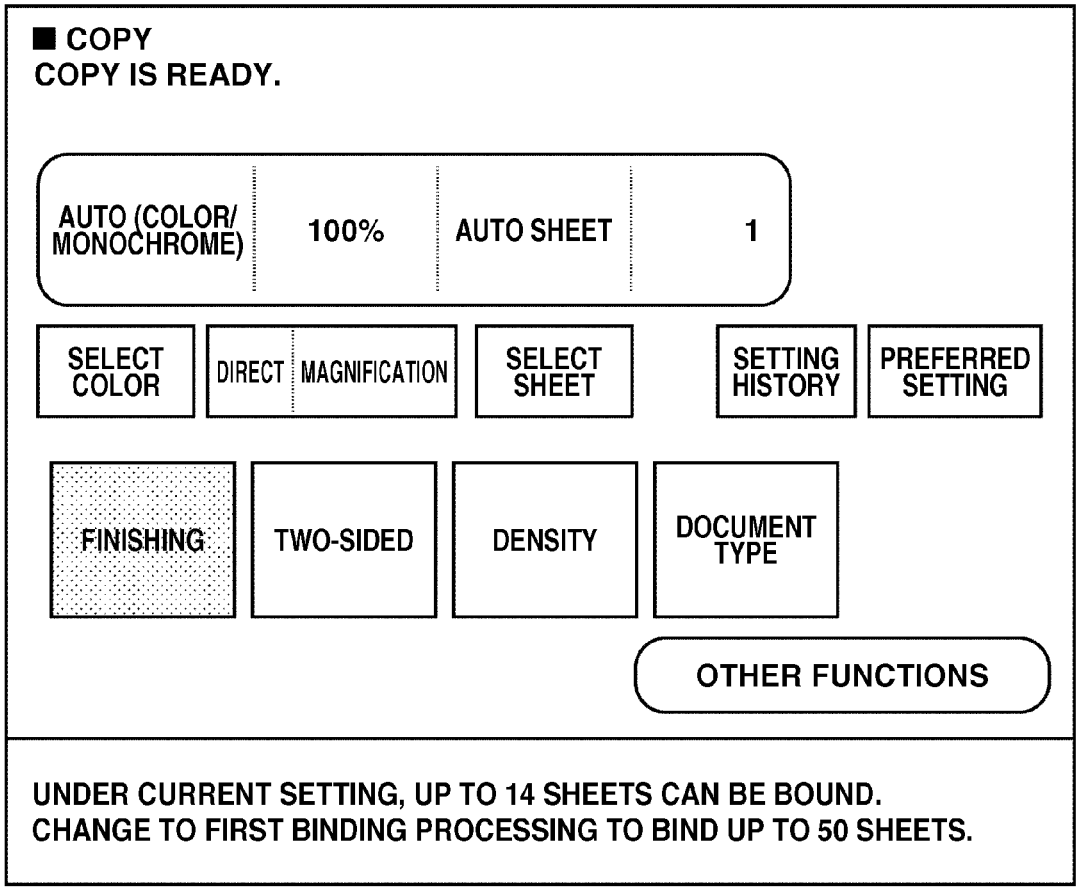
FIG. 11 is a diagram illustrating an example of a user interface screen for displaying the maximum numbers of sheets.

FIG. 11 is a diagram illustrating an example of a user interface screen for displaying the maximum numbers of sheets. In the example of FIG. 11, the user interface screen for making a copy setting is displayed with a message about the maximum numbers of sheets. FIG. 11 illustrates an example where the image processing apparatus includes both the first and second binding units and the user has selected the second binding processing.

Reading the message about the maximum numbers of sheets, the user can determine whether the binding processing he/she has designated is sufficient. The user may further check the number of sheets that can be bound by the binding processing other than the binding processing he/she has designated, and consider using the other binding processing.

If the sheet processing unit 109 includes only one type of binding unit (NO in step S805), then in step S811, the CPU 101 calculates the maximum number of sheets that can be bound by the binding processing executable by the sheet processing unit 109. In such a case, the CPU 101 assumes that the exclusive binding processing has been selected.

If the key 602 is pressed on the user interface screen of FIG. 6 (KEY 602 in step S804), the CPU 101 returns to step S801 without making a finishing setting. If the key 603 is pressed on the user interface screen of FIG. 6 (KEY 603 in step S804), then in step S812, the CPU 101 determines whether any binding processing has been selected as finishing processing. If no binding processing has been selected (NO in step S812), the CPU 101 stores the contents set or selected by the user into the SRAM 103 as setting values, and returns to step S801. If any binding processing has been selected (YES in step S812), then in step S810, the CPU 101 controls the operation unit 105 to display the maximum numbers of sheets calculated in steps S807 and S808. If the sheet processing unit 109 includes only one type of binding unit, then in step S810, the CPU 101 controls the operation unit 105 to display the maximum number of sheets calculated in step S811.

Now, FIG. 9 will be described.

If the key 1001 is not pressed on the user interface screen of FIG. 10 (NO in step S802), then in step S901, the CPU 101 determines whether a key 1002 is pressed on the user interface screen of FIG. 10. If the key 1002 is pressed (YES in step S901), then in step S902, the CPU 101 controls the operation unit 105 to display a user interface screen for selecting sheets to be used for printing.

Figure 12:
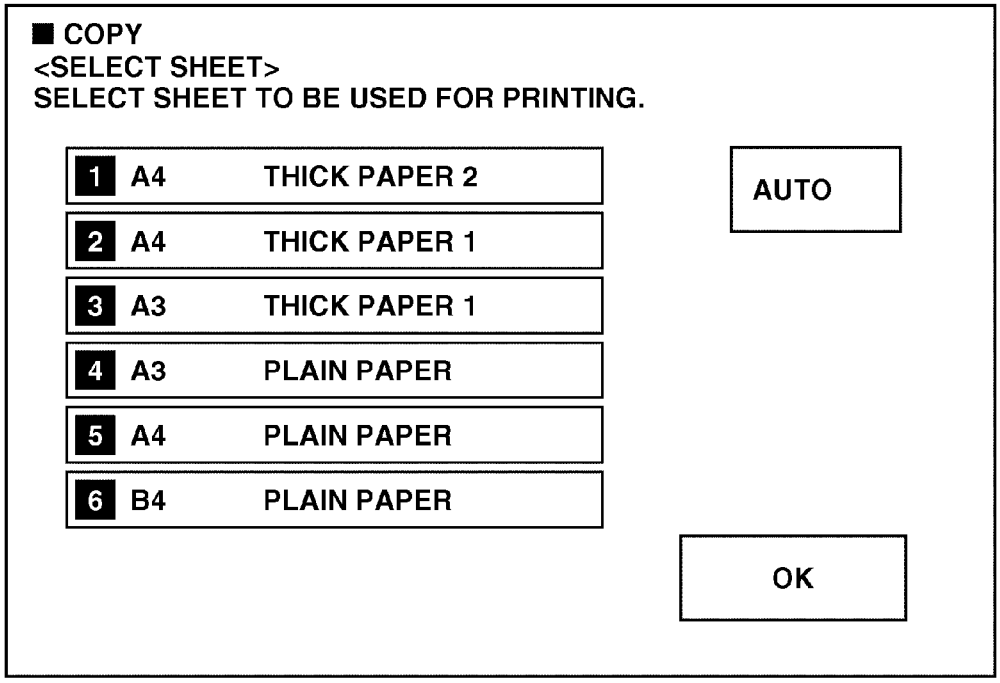
FIG. 12 is a diagram illustrating an example of a user interface screen for selecting sheets.

FIG. 12 is a diagram illustrating an example of the user interface screen displayed in step S902. On the user interface screen of FIG. 12, the user selects at least one of the plurality of sheet feeding units to select a sheet to be used for printing. If the user presses an "auto" key, the image processing apparatus automatically selects a sheet to be used for printing based on a document size. If the user presses an OK key, the CPU 101 returns to step S801.

If the key 1002 is not pressed on the user interface screen of FIG. 10 (NO in step S901), then in step S903, the CPU 101 determines whether a key 1003 is pressed on the user interface screen of FIG. 10. If the key 1003 is pressed (YES in step S903), then in step S904, the CPU 101 controls the operation unit 105 to display a user interface screen for making a page aggregate setting.

FIG. 13 is a diagram illustrating an example of the user interface screen displayed in step S904. On the user interface screen of FIG. 13, the user can select the number of pages to be allocated to a single sheet. If the user presses an OK key, the CPU 101 returns to step S801. If the user presses a cancel setting key, the CPU 101 returns to step S801 without making the page aggregate setting.

If the key 1003 is not pressed on the user interface screen of FIG. 10 (NO in step S903), then in step S905, the CPU 101 determines whether a key 1004 is pressed on the user interface screen of FIG. 10. If the key 1004 is pressed (YES in step S905), then in step S906, the CPU 101 controls the operation unit 105 to display a user interface screen for selecting a type of two-sided copying.

Figure 14:
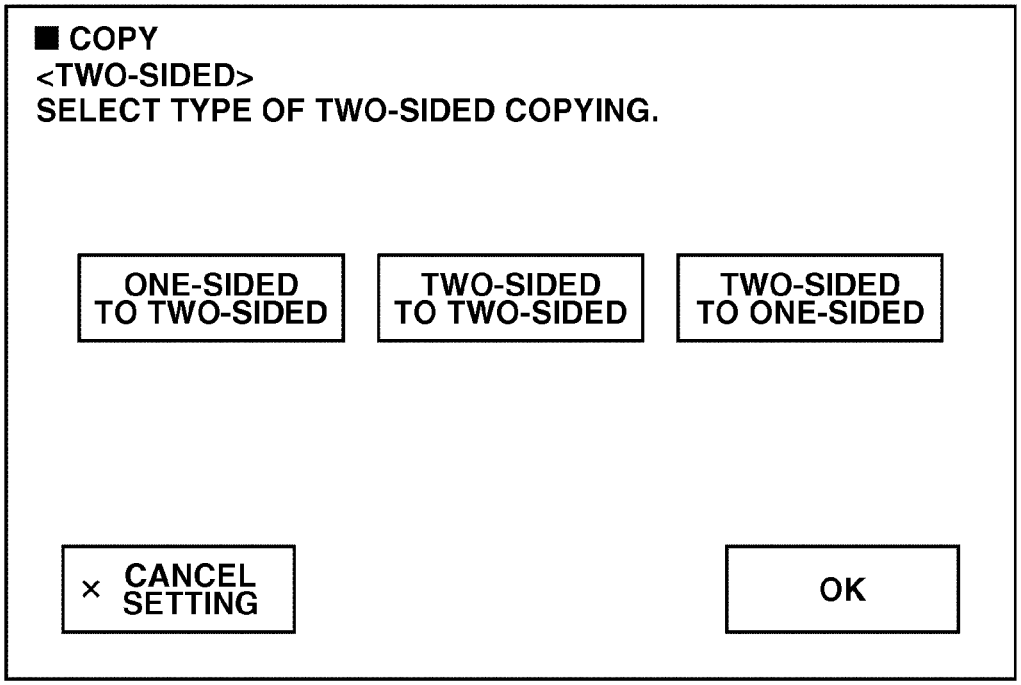
FIG. 14 is a diagram illustrating an example of a user interface screen for selecting a type of two-sided copying.

FIG. 14 is a diagram illustrating an example of the user interface screen displayed in step S906. On the user interface screen of FIG. 14, the user can select to copy one side of each of two documents to both sides of a sheet, to copy both sides of a document to both sides of a sheet, or to copy both sides of a document to one side of each of two sheets. If the user presses an OK key, the CPU 101 returns to step S801. If the user presses a cancel setting key, the CPU 101 returns to step S801 without selecting the type of two-sided copying.

If the key 1004 is not pressed on the screen of FIG. 10 (NO in step S905), then in step S907, the CPU 101 determines whether a start button (not illustrated) is pressed. If the start button is pressed (YES in step S907), then in step S908, the CPU 101 controls the reading unit 106 and the printing unit 107 according to the setting values stored in the SRAM 103 to perform copying.

If the start button is not pressed (NO in step S907), the CPU 101 returns to step S801. On the user interface screen of FIG. 10, the user can make other settings. In FIG. 10, a description of the other settings will be omitted.

Now, a method for calculating the maximum number of sheets that can be bound by binding process to be calculated will be described.

FIG. 15 is a diagram illustrating a flowchart of calculation processing for calculating the maximum number of sheets. The CPU 101 performs such calculation processing in steps S807, S808, and S811.

In step S1501, the CPU 101 determines whether the binding processing to be calculated is the first binding processing or the second binding processing. If the binding processing to be calculated is the first binding processing (FIRST BINDING PROCESSING in step S1501), then in step S1502, the CPU 101 determines the maximum number of sheets to be 50. On the other hand, if the binding processing to be calculated is the second binding processing (SECOND BINDING PROCESSING in step S1501), then in step S1503, the CPU 101 determines the maximum number of sheets to be 14.

The maximum number of sheets that can be bound by the first binding processing varies depending on specifications of the first binding unit. Similarly, the maximum number of sheets that can be bound by the second binding processing varies depending on specifications of the second binding unit.

Figure 16:
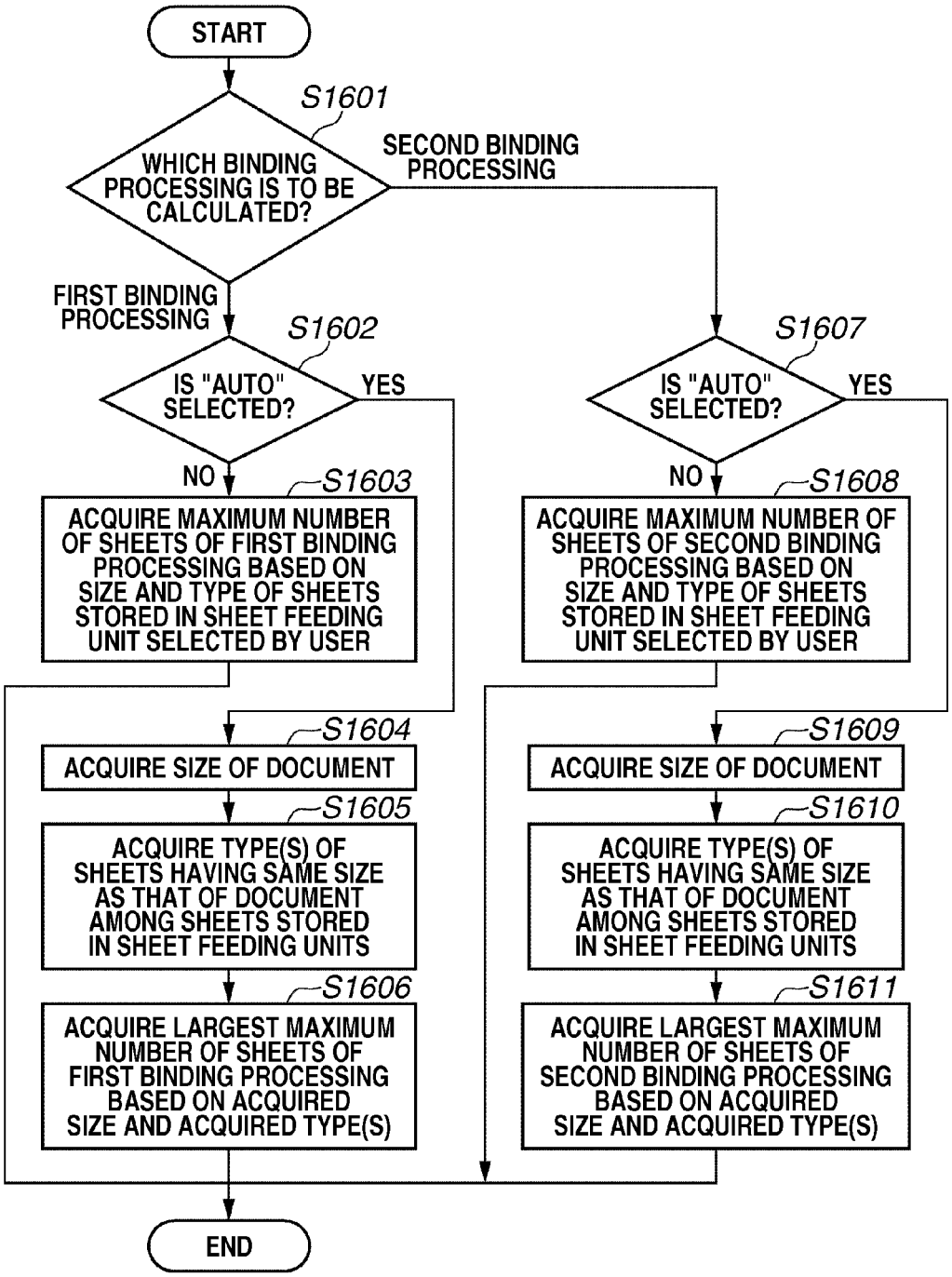
FIG. 16 is a diagram illustrating a flowchart of another calculation processing for calculating the maximum number of sheets.

FIG. 16 is a diagram illustrating a flowchart of different calculation processing for calculating the maximum number of sheets. In the example of FIG. 16, the CPU 101 determines the maximum number of sheets in consideration of the type of the sheets to be used for printing. For example, thick paper is thicker than plain paper. Bound sheets of thick paper are easier to exfoliate than bound sheets of plain paper. The maximum number of sheets of thick paper that can be bound is therefore smaller than that of plain paper. A3 plain paper is wider in area and greater in weight than A4 plain paper. Bound sheets of A3plain paper are easier to exfoliate than bound sheets of A4plain paper. The maximum number of sheets of A3plain paper that can be bound is therefore smaller than that of A4plain paper. In the example of FIG. 16, the CPU 101 can determine the maximum number of sheets in consideration of the ease of exfoliation which varies with sheet size and sheet type.

FIG. 17 is a diagram illustrating an example of a table used to calculate the maximum number of sheets. The table of FIG. 17 contains the maximums number of sheets for each type of binding processing by sheet size and sheet type. For example, if the sheets to be used for printing have a paper size of A3and a sheet type of plain paper, the maximum number of sheets that can be bound by the first binding processing is 38. The table of FIG. 17 is stored in the SRAM 103. The maximum numbers of sheets listed on the table of FIG. 17 may be fixed or changed by the user.

In step S1601, the CPU 101 determines whether the binding processing to be calculated is the first binding processing or the second binding processing.

If the binding processing to be calculated is the first binding processing (FIRST BINDING PROCESSING in step S1601), then in step S1602, the CPU 101 determines whether "auto" is selected on the user interface screen of FIG. 12. If "auto" is not selected (NO in step S1602), then in step S1603, the CPU 101 refers to the table of FIG. 17 to acquire the maximum number of sheets of the first binding processing from the table based on the size and type of the sheets stored in the sheet feeding unit selected by the user.

FIG. 18 illustrates an example of a table listing the sizes and types of sheets stored in the respective sheet feeding units. The table of FIG. 18 is stored in the SRAM 103. In the example of FIG. 18, the image processing apparatus includes three sheet feeding cassettes and three sheet feeding decks as the sheet feeding units. The CPU 101 refers to the table of FIG. 18 to determine the size and type of the sheets stored in the sheet feeding unit selected by the user.

If "auto" is selected on the user interface screen of FIG. 12 (YES in step S1602), i.e., if automatic sheet selection is selected, then in step S1604, the CPU 101 acquires the size of a document. The reading unit 106 includes a sensor. The sensor detects the size of the document placed on the reading unit 106. The CPU 101 acquires the size detected by the sensor.

In step S1605, the CPU 101 acquires the type of sheets having the same size as that of the document from among the sheets stored in the sheet feeding units. If there is a plurality of types of a sheet or sheets having the same size as that of the document, the CPU 101 acquires the plurality of types. In step S1606, the CPU 101 refers to the table of FIG. 17 to acquire the largest maximum number of sheets of the first binding processing from the table based on the size acquired in step S1604 and the type or types acquired in step S1605. The CPU 101 further selects the sheets corresponding to the largest maximum number of sheets as the sheets to be used for printing.

Suppose, for example, a document has a size of A4. The CPU 101 refers to the table of FIG. 18 to acquire thick paper 2, thick paper 1, and plain paper as the types of A4-sized sheets. The CPU 101 then refers to the table of FIG. 17 and acquires "38" (A4, thick paper 2), "42" (A4, thick paper 1), and "46" (A4, plain paper) based on A4, thick paper 2, thick paper 1, and plain paper. The CPU 101 then determines "46," which is the largest number out of "38," "42," and "46," to be the largest maximum number of sheets of the first binding processing. When performing copying, the image processing apparatus then uses A4plain paper for printing.

If the binding processing to be calculated is the second binding processing (SECOND BINDING PROCESSING in step S1601), then in step S1607, the CPU 101 determines whether "auto" is selected on the user interface screen of FIG. 12. If "auto" is not selected (NO in step S1607), then in step S1608, the CPU 101 refers to the table of FIG. 17 to acquire the maximum number of sheets of the second binding processing from the table based on the size and type of the sheets stored in the sheet feeding unit selected by the user.

If "auto" is selected on the user interface screen of FIG. 12 (YES in step S1607), i.e., if the automatic sheet selection is selected, then in step S1609, the CPU 101 acquires the size of a document. In step S1610, the CPU 101 acquires the type of a sheet or sheets having the same size as that of the document among the sheets stored in the sheet feeding units. If there is a plurality of types of sheets having the same size as that of the document, the CPU 101 acquires the plurality of types. In step S1611, the CPU 101 refers to the table of FIG. 17 to acquire the largest maximum number of sheets of the second binding processing based on the size acquired in step S1609 and the type(s) acquired in step S1610. The CPU 101 further selects the sheets corresponding to the largest maximum number of sheets as the sheets to be used for printing.

In the example based on FIGS. 8, 9, 15, and 17, the CPU 101 displays the maximum number(s) of sheets that can be bound by the binding processing. In an example based on FIGS. 19 to 21, the CPU 101 displays how many documents the binding processing can be performed for. For example, even if the maximum number of sheets that can be bound is 10, the binding processing can be performed for 20 documents if a copy setting is made such that one-sided documents are copied to both sides of sheets. In such a case, the maximum number of documents the binding processing can be performed for is 20.

Figure 19:
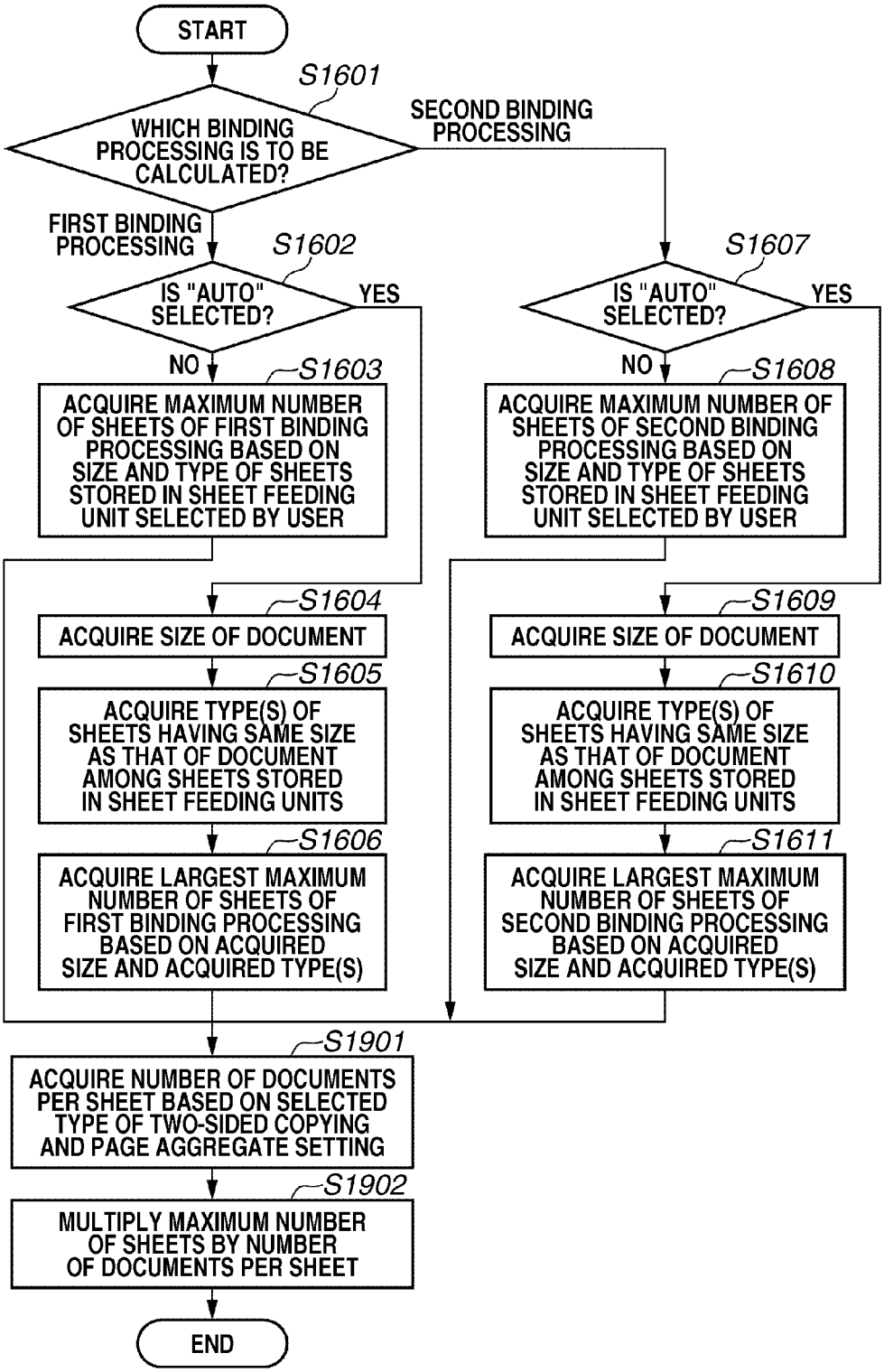
FIG. 19 is a diagram illustrating a flowchart of calculation processing for calculating the maximum number of documents.

FIG. 19 is diagram illustrating a flowchart of calculation processing for calculating the maximum number of documents. The calculation processing of FIG. 19 can be performed in steps S807, S808, and S811 of FIG. 8 to display the maximum number of documents.

FIG. 20 is a diagram illustrating an example of a table used to calculate the maximum number of documents. The table of FIG. 20 lists the numbers of documents that can be copied to a single sheet under respective print settings. "One-sided to one-sided" represents copying one side of a document to one side of a sheet. "One-sided to two-sided" represents copying one side of each of two documents to both sides of a sheet. "Two-sided to two-sided" represents copying both sides of a document to both sides of a sheet. "Two-sided to one-sided" represents copying both sides of a document to one side of each of two sheets. The table of FIG. 20 is stored in the SRAM 103.

Steps SS601 to S1611 of FIG. 19 are the same as steps S1601 to S1611 of FIG. 16. In the flowchart of FIG. 19, a description of steps S1601 to S1611 will thus be omitted.

In step S1901, having acquired the maximum number of sheets in step S1603, S1606, S1608, or S1611, the CPU 101 refers to the table of FIG. 20 to acquire the number of documents per sheet based on the selected type of two-sided copying and the page aggregate setting. The type of two-sided copying is selected in step S906 of FIG. 9. If no type of two-sided copying has been selected, the CPU 101 assumes that copying one side of a document to one side of a sheet is selected. The page aggregate setting is made in step S904 of FIG. 9. For example, if the user selects copying one side of each of two documents to a sheet and four pages per sheet, the number of documents per sheet is eight.

In step S1902, the CPU 101 multiplies the maximum number of sheets acquired in step S1603, S1606, S1608, or S1611 by the number of documents acquired in step S1901 to determine the maximum number of documents for which the binding processing can be performed. For example, if the user selects A4, plain paper, the second binding processing, copying one side of each of two documents to both sides of a sheet, and four pages per sheet, then the maximum number of documents for which the binding processing can be performed is 104 (=13×8).

Figure 21:
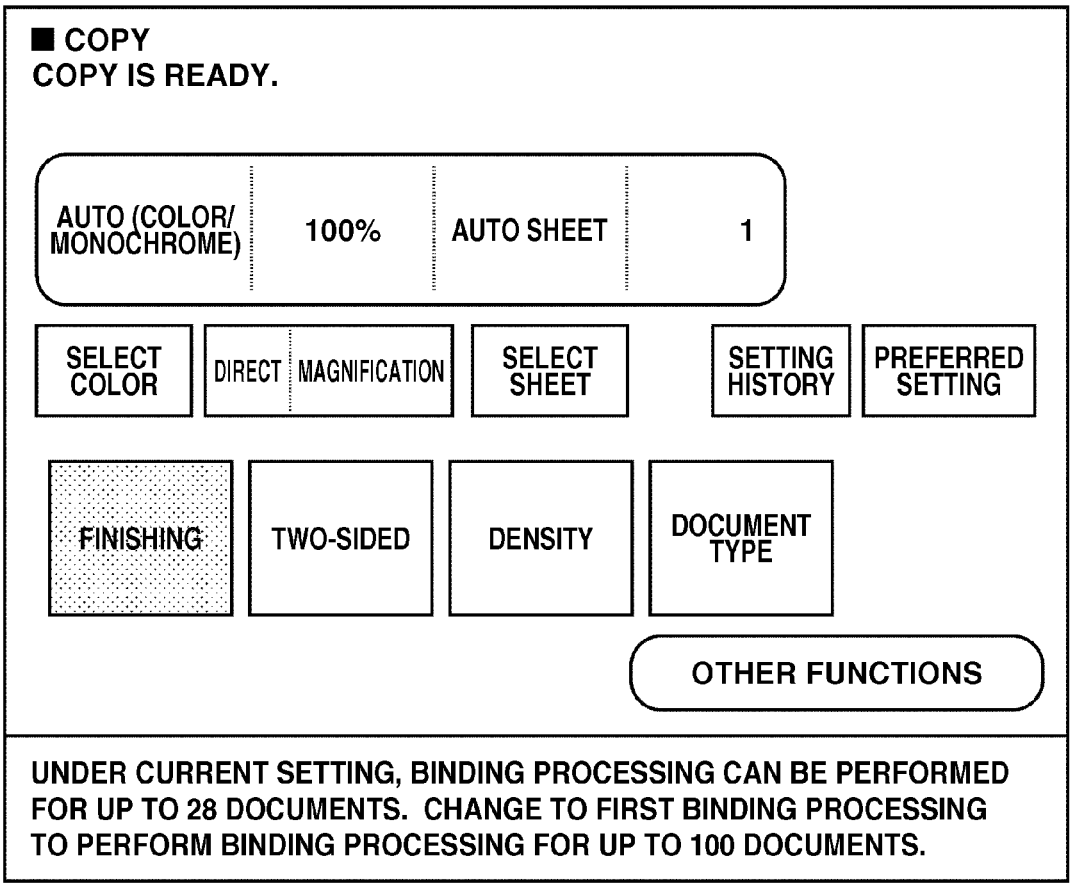
FIG. 21 is a diagram illustrating an example of a user interface screen for displaying a message about the maximum number of documents.

FIG. 21 is a diagram illustrating an example of a user interface screen for displaying a message about the maximum number of documents.

Reading the message about the maximum number of documents, the user can check how many documents sheets can be bound for, and determine whether the binding processing he/she has designated is sufficient. For example, if the number of documents is greater than the maximum number of documents stated in the message, the user may consider selecting different binding processing and/or changing the copy setting.

In FIGS. 11 and 21, a display unit that displays the maximum number of documents or sheets is employed as a notification unit for notifying the maximum number of documents or sheets to the user. However, the maximum number of documents or sheets may be vocally notified to the user.

While the first exemplary embodiment has described one type of exemplary image processing apparatus, the present exemplary embodiment can be applied to an information processing apparatus that transmits print data to an image processing apparatus.

Figure 22:
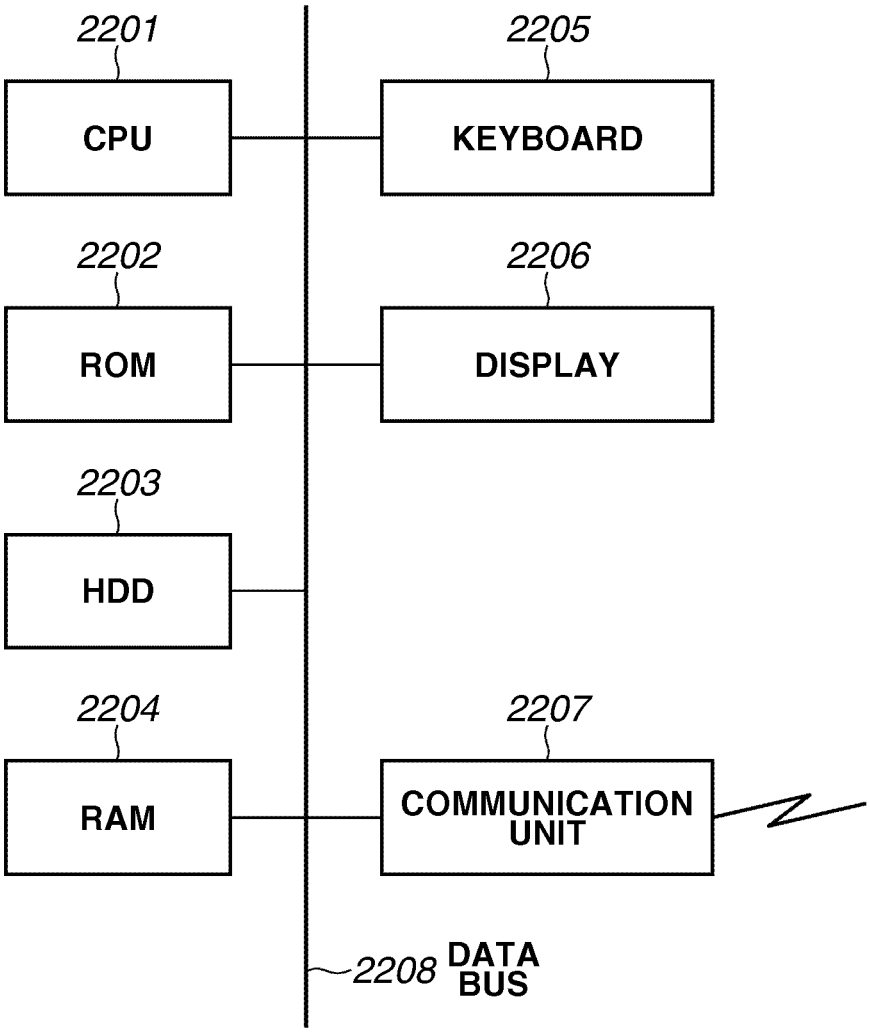
FIG. 22 is a block diagram illustrating a configuration of an information processing apparatus according to an exemplary embodiment.

FIG. 22 is a block diagram illustrating a configuration of an information processing apparatus according to a second exemplary embodiment. The information processing apparatus has a function of transmitting print data to an image processing apparatus to make the image processing apparatus perform printing based on the print data.

A CPU 2201 is a control unit of the information processing apparatus. The CPU 2201 executes a program to control the entire information processing apparatus. A ROM 2202 stores a control program executable by the CPU 2201. A HDD 2203 stores setting values registered by the user, management data on the information processing apparatus, application programs such as a document application and a calculation application, and a driver program for transmitting print data to the image processing apparatus. A RAM 2204 stores control variables of the programs executed by the CPU 2201. The RAM 2204 also functions as a working buffer of the CPU 2201.

A keyboard 2205 is used to input instructions from the user and input characters and numerals. A mouse may be prepared aside from the keyboard 2205. A display 2206 displays information to the user.

A communication unit 2207 communicates with an external apparatus. The communication unit 2207 transmits print data to the image processing apparatus and/or receives image data from the image processing apparatus. The communication unit 2207 communicates with an external apparatus via a network such as a wired LAN and a wireless LAN, and/or communicates with an external apparatus via a local interface such as USB. A data bus 2208 transfers data and control signals between various devices.

Figure 23:
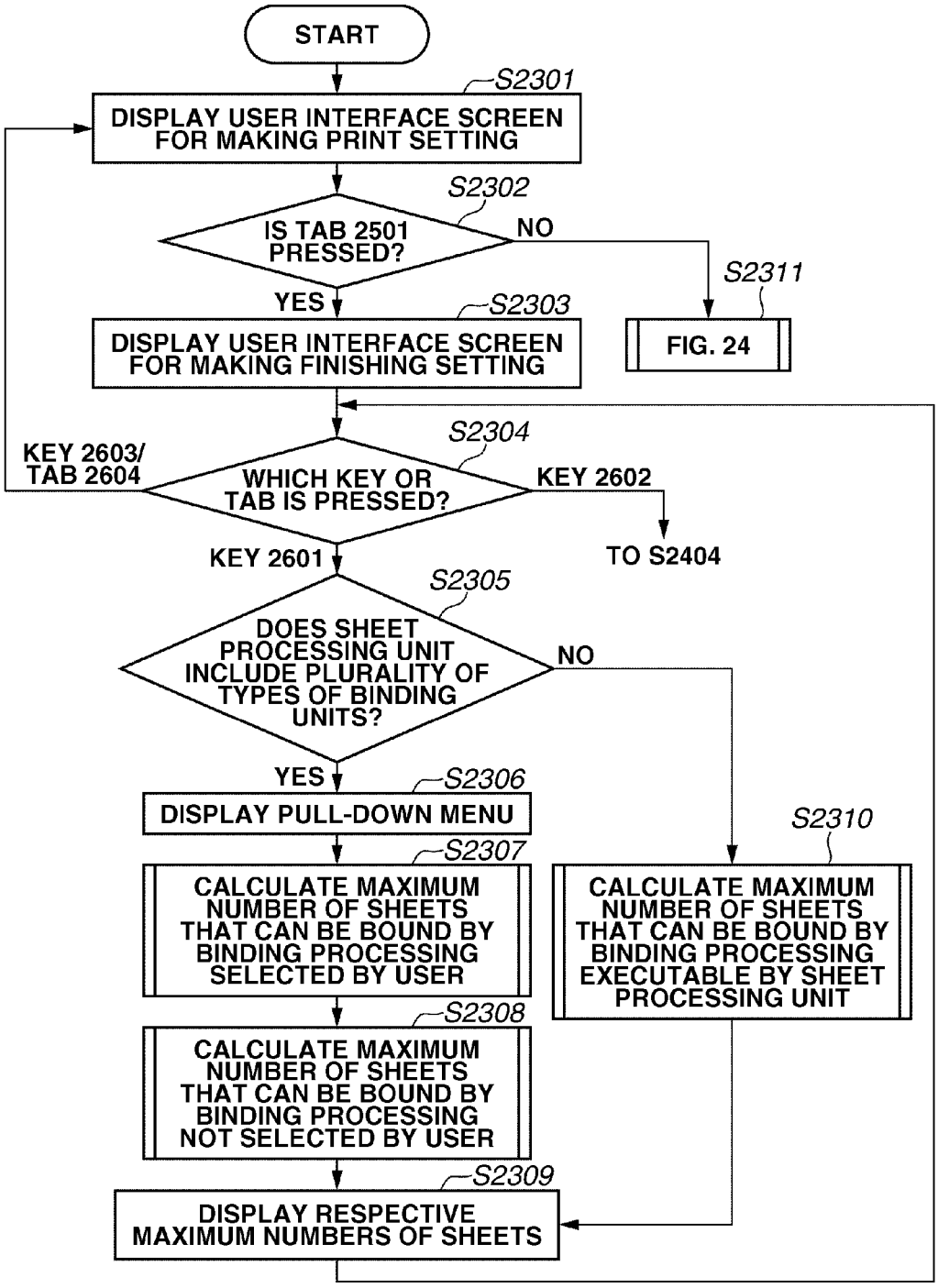
FIG. 23 is a flowchart illustrating a control method for transmitting print data to an image processing apparatus.
Figure 24:
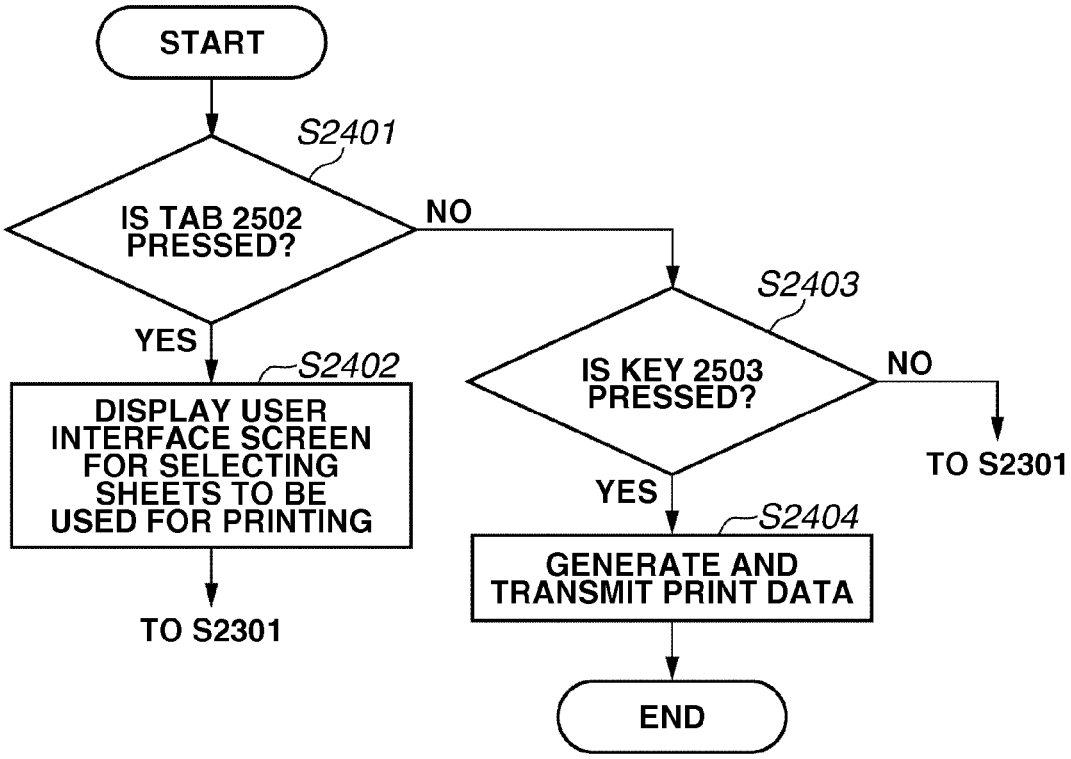
FIG. 24 is a flowchart illustrating the control method for transmitting print data to the image processing apparatus.

FIGS. 23 and 24 are flowcharts illustrating a control method for transmitting print data to the image processing apparatus. The CPU 2201 executes a driver program based on the flowcharts to implement the control method.

When the user gives an instruction for data printing, the CPU 2201 executes the driver program. In step S2301, the CPU 2201 controls the display 2206 to display a user interface screen for making a print setting.

Figure 25:
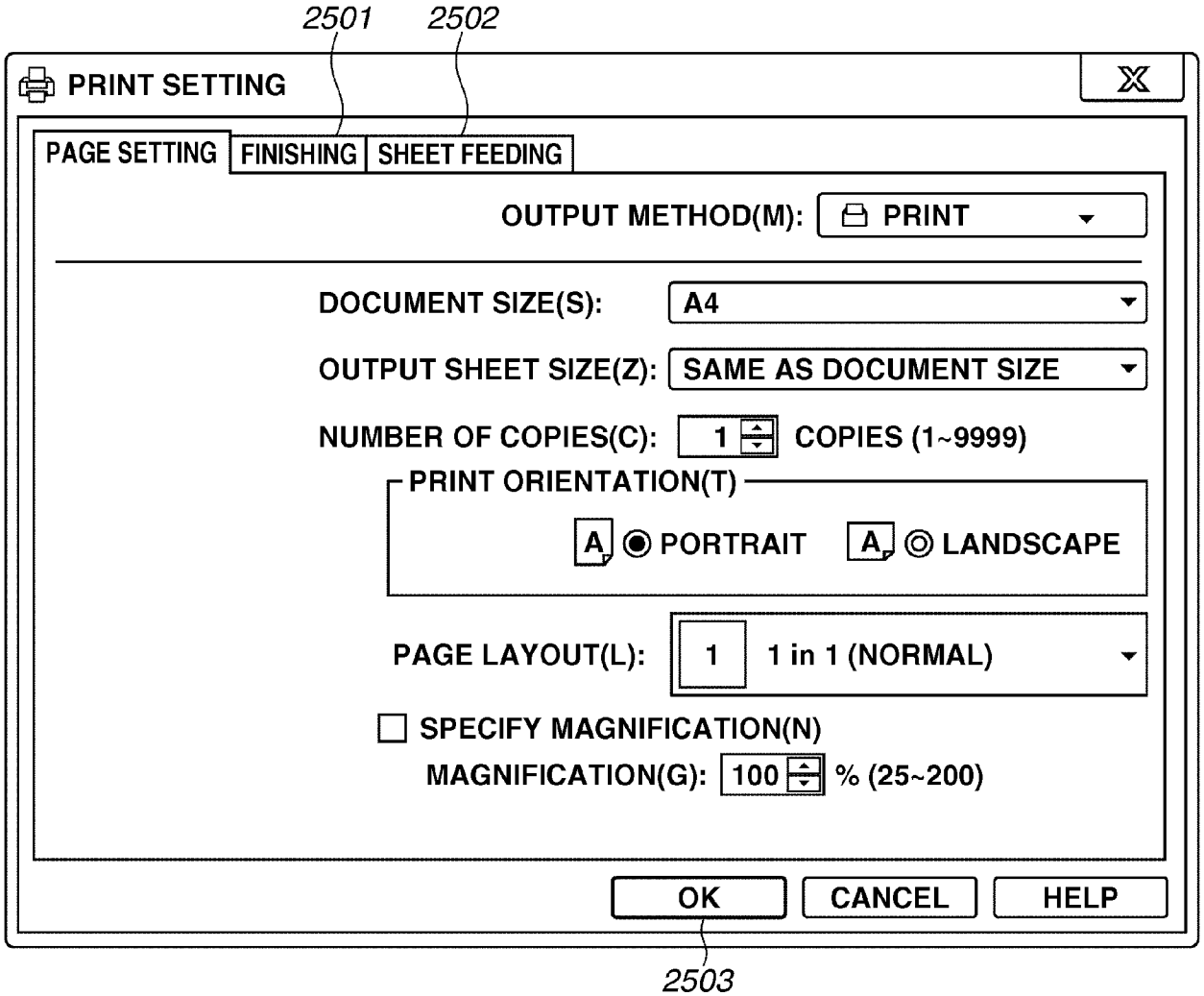
FIG. 25 is a diagram illustrating an example of a user interface screen displayed in step S2301 of FIG. 23.

FIG. 25 is a diagram illustrating an example of the user interface screen displayed in step S2301. On the user interface screen of FIG. 25, the user can set a document size, a size of sheet to be printed, the number of copies, print orientation, and page layout (page aggregate). To make a finishing setting, the user presses a tab 2501.

In step S2302, the CPU 2201 determines whether the tab 2501 is pressed on the user interface screen of FIG. 25. If the tab 2501 is not pressed (NO in step S2302), then in step S2311, the CPU 101 proceeds to the flowchart of FIG. 24.

Figure 26:
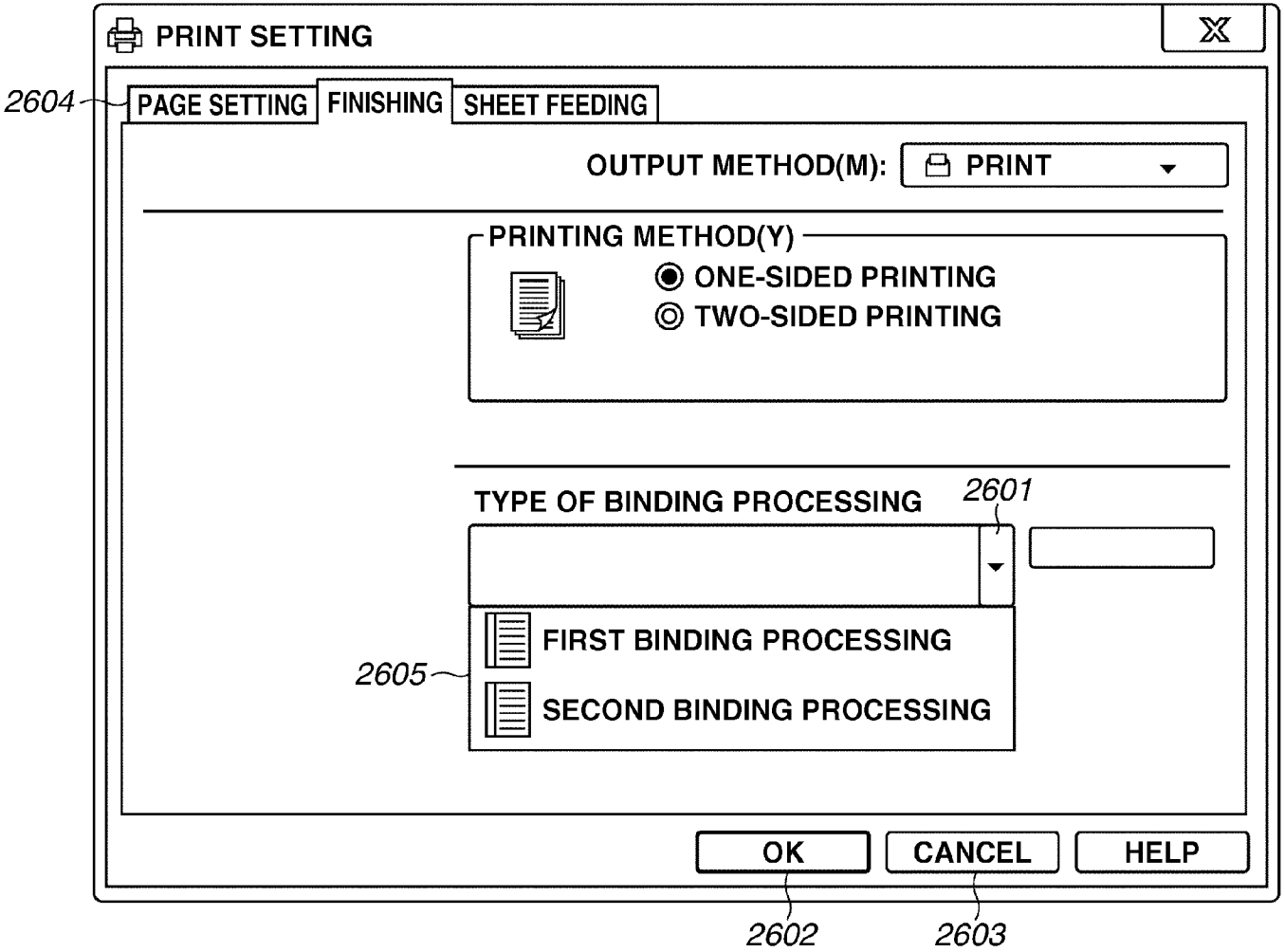
FIG. 26 is a diagram illustrating an example of a user interface screen for making a finishing setting.

If the tab 2501 is pressed (YES in step S2302), then in step S2303, the CPU 2201 controls the display 2206 to display a user interface screen illustrated in FIG. 26. On the user interface screen of FIG. 26, the user can select either one-sided printing or two-sided printing, and select a type of binding processing. In step S2304, the CPU 2201 determines which of keys 2601 to 2603 and a tab 2604 is pressed on the user interface screen of FIG. 26.

If the key 2601 is pressed on the user interface screen of FIG. 26 (KEY 2601 in step S2304), then in step S2305, the CPU 2201 determines whether the sheet processing unit 109 includes a plurality of types of binding units. If the sheet processing unit 109 includes a plurality of types of binding units, i.e., the first binding unit and the second binging unit (YES in step S2305), then in step S2306, the CPU 2201 controls the display 2206 to display a pull-down menu 2605. If the user selects either the first binding processing or the second binding processing from the pull-down menu 2605, then in step S2307, the CPU 2201 calculates the maximum number of sheets that can be bound by the binding processing selected by the user. In step S2308, the CPU 2201 further calculates the maximum number of sheets that can be bound by the binding processing not selected by the user. The calculation method in steps S2307 and S2308 is the same as described in the first exemplary embodiment. In step S2309, the CPU 2201 controls the display 2206 to display the respective maximum numbers of sheets calculated in steps S2307 and S2308.

Figure 27:
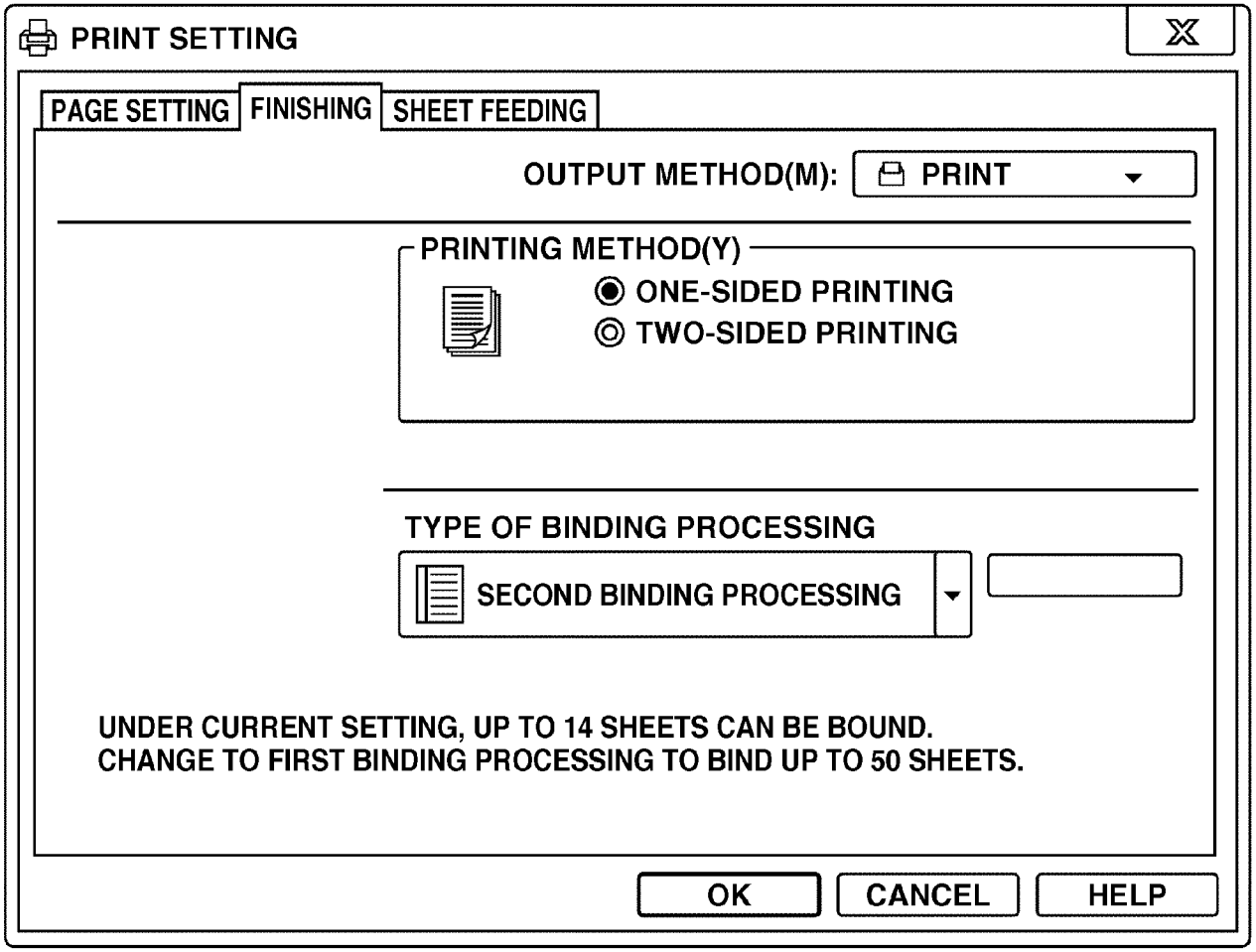
FIG. 27 is a diagram illustrating an example of a user interface screen for displaying the maximum numbers of sheets.

FIG. 27 is a diagram illustrating an example of a user interface screen for displaying the maximum numbers of sheets. In the example of FIG. 27, a message about the maximum numbers of sheets is displayed. FIG. 27 illustrates an example where the image processing apparatus includes both the first and second binding units and the user has selected the second binding processing.

Reading the message about the maximum numbers of sheets, the user can determine whether the binding processing he/she has designated is sufficient. The user can further check the number of sheets that can be bound by the binding processing other than the binding processing he/she has designated, and consider using the other binding processing.

If the key 2602 is pressed on the user interface screen of FIG. 26 (KEY 2602 in step S2304), the CPU 2201 stores the contents selected by the user into the HDD 2203 as setting values, and proceeds to step S2404 of FIG. 24. If the key 2603 is pressed on the user interface screen of FIG. 26 (KEY 2603/TAB 2604 in step S2304), the CPU 2201 returns to step S2301 without making a finishing setting. If the tab 2604 is pressed on the user interface screen of FIG. 26 (KEY 2603/TAB 2604 in step S2304), the CPU 2201 stores the contents selected by the user into the HDD 2203 as setting values, and returns to step S2301.

If the sheet processing unit 109 includes only one type of binding unit (NO in step S2305), then in step S2310, the CPU 2201 calculates the maximum number of sheets that can be bound by the binding processing executable by the sheet processing unit 109. The calculation method in step S2310 is the same as described in the first exemplary embodiment. Here, the CPU 2201 assumes the only binding processing to be selected. In step S2309, the CPU 2201 controls the display 2206 to display the maximum number of sheets calculated in step S2310.

FIG. 24 will be described.

If the tab 2501 is not pressed on the user interface screen of FIG. 25 (NO in step S2302), then in step S2401, the CPU 2201 determines whether a tab 2502 is pressed on the user interface screen of FIG. 25. If the tab 2502 is pressed (YES in step S2401), then in step S2402, the CPU 2201 controls the display 2206 to display a user interface screen for selecting a sheet to be used for printing.

On the user interface screen displayed in step S2402, the user selects at least one of the plurality of sheet feeding units to select a sheet to be used for printing. If the user selects "auto," the image processing apparatus automatically selects a sheet to be used for printing based on the document size.

If the tab 2502 is not pressed on the user interface screen of FIG. 25 (NO in step S2402), then in step S2403, the CPU 2201 determines whether a key 2503 is pressed on the user interface screen of FIG. 25. If the key 2503 is pressed (YES in step S2403), then in step S2404, the CPU 2201 generates print data according to the setting values stored in the HDD 2203. In step S2404, the CPU 2201 further controls the communication unit 2207 to transmit the print data to the image processing apparatus. The image processing apparatus prints images on sheets based on the print data, and controls the binding unit to perform the binding processing designated by the print data.

If the key 2503 is not pressed (NO in step S2403), the CPU 2201 returns to step S2301. On the user interface screen of FIG. 25, the user can make other settings. A description of the other settings will be omitted.

In steps S2307, S2308, and S2310, the CPU 2201 may perform the calculation methods illustrated in FIGS. 15, 16, and 17. In the second exemplary embodiment, a document refers to document data generated by an application program.

In the second exemplary embodiment, when the information processing apparatus transmits print data to the image processing apparatus, the information processing apparatus enables the user to check how many sheets can be bound by each of the plurality of types of binding processing. When document data serving as documents are printed onto sheets and the printed sheets are bound, the information processing apparatus enables the user to check how many pages of document data sheets can be bound for by each of the plurality of types of binding processing.

Embodiments of the present invention can also be realized by a computer of a system or apparatus that reads out and executes computer executable instructions recorded on a storage medium (e.g., computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

A control circuit designed to perform the processing based on the flowcharts may be used instead of the CPU 101.

According to an exemplary embodiment of the present invention, the user can check how many sheets can be bound by each of a plurality of types of binding processing. In the case of printing document images on sheets and binding the printed sheets, the user can check how many documents sheets can be bound for by each of the plurality of types of binding processing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-145658 filed Jun. 28, 2012, which is hereby incorporated by reference herein in its entirety.

What is claimed is:

1. An image processing apparatus capable of printing an image on a sheet and controlling one of a plurality of binding units to bind sheets, the plurality of binding units being configured to perform a respective plurality of types of binding processes, the image processing apparatus comprising:

a printing unit configured to print an image on a sheet;

a control unit configured to control one of the plurality of binding units to bind sheets on which images are printed by the printing unit;

a designation unit configured to enable designation of a binding process to be used to bind the sheets; and a selection unit configured to select a sheet to be used for printing that has a greatest quantity that can be bound by the designated binding process, from a plurality of different types of sheets having the same size, wherein the printing unit prints an image on the type of sheet selected by the selection unit.

2. The image processing apparatus according to claim 1, further comprising a determination unit configured to determine a number of sheets that can be bound by each of the plurality of types of binding processes based on a size or a type of sheets to be used for printing.

3. The image processing apparatus according to claim 2, further comprising a storage unit configured to store a table indicating the number of sheets that can be bound by each of the plurality of types of binding processes with respect to each size of sheets or each type of sheets, wherein the determination unit refers to the table to determine the number of sheets that can be bound by each of the plurality of types of binding processes.

4. The image processing apparatus according to claim 1, further comprising a notification unit configured to provide notification of a number of sheets that can be bound by the designated binding process and a number of sheets that can be bound by a non-designated binding process.

5. The image processing apparatus according to claim 4, wherein the designation unit enables changing the binding process to be used to bind the sheets after the notification unit notifies the number of sheets that can be bound by the designated binding process and the number of sheets that can be bound by the non-designated binding process, and wherein the control unit controls the binding unit that is configured to perform the changed binding process to bind the sheets.

6. The image processing apparatus according to claim 1, wherein the plurality of binding units includes a first binding unit configured to bind sheets with a staple and a second binding unit configured to bind sheets without a staple.

7. An image processing apparatus capable of printing an image on a sheet and controlling one of a plurality of binding units to bind the sheets, the plurality of binding units being configured to perform a respective plurality of types of binding processes, the image processing apparatus comprising:

a reading unit configured to read an image of a document;

a printing unit configured to print the image on a sheet;

a control unit configured to control one of the plurality of binding units to bind sheets on which images are printed by the printing unit;

a designation unit configured to enable designation of a binding process to be used to bind the sheets; and a selection unit configured to select a sheet to be used for printing that has the greatest quantity that can be bound by the designated binding process from a plurality of different types of sheets having the same size, wherein the printing unit prints an image on the sheet selected by the selection unit.

8. The image processing apparatus according to claim 7, further comprising a notification unit configured to provide notification of a number of documents for which the designated binding process can be used and a number of documents for which a non-designated binding process can be used.

9. The image processing apparatus according to claim 8, further comprising a determination unit configured to determine a number of sheets that can be bound by each of the plurality of types of binding processes based on a size or a type of sheets to be used for printing, and to determine a number of documents for which each of the plurality of types of binding processes can be used.

10. The image processing apparatus according to claim 9, further comprising a storage unit configured to store a table indicating the number of sheets that can be bound by each of the plurality of types of binding processes with respect to each size of sheets or each type of sheets, wherein the determination unit refers to the table to determine the number of sheets that can be bound by each of the plurality of types of binding processes.

11. The image processing apparatus according to claim 9, wherein the determination unit determines the number of documents for which each of the plurality of types of binding processes can be used based on a setting with which images of documents are printed on sheets and the number of sheets that can be bound by each of the plurality of types of binding processes.

12. The image processing apparatus according to claim 7, wherein the plurality of binding units includes a first binding unit configured to bind sheets with a staple and a second binding unit configured to bind sheets without a staple.

13. A method for controlling an image processing apparatus capable of printing an image on a sheet and controlling one of a plurality of binding units to bind the sheets, the plurality of binding units being configured to perform a respective plurality of types of binding processes, the method comprising:

printing an image on a sheet;

enabling designation of a binding process to be used to bind sheets on which images are printed; and selecting a sheet to be used for printing that has a greatest quantity that can be bound by the designated binding process, from a plurality of different types of sheets having the same size, wherein the image is printed on the selected type of sheet.

14. A method for controlling an image processing apparatus capable of printing an image on a sheet and controlling one of a plurality of binding units to bind the sheets, the plurality of binding units being configured to perform a respective plurality of types of binding processes, the method comprising:

reading an image of a document;

printing the image on a sheet;

enabling designation of a binding process to be used to bind sheets on which images are printed; and selecting a sheet to be used for printing that has the greatest quantity that can be bound by the designated binding process from a plurality of different types of sheets having the same size, wherein the image is printed on the selected sheet.

15. A non-transitory storage medium storing a program for controlling a computer of an image processing apparatus capable of printing images on sheets and controlling one of a plurality of binding units to bind the sheets, the plurality of binding units being configured to perform a respective plurality of types of binding processes, the program controlling the computer to:

control a printing unit to print an image on a sheet;

control one of the plurality of binding units to bind sheets on which images are printed by the printing unit; and select a sheet to be used for printing that has a greatest quantity that can be bound by the designated binding process, from a plurality of different types of sheets having the same size, wherein the image is printed on the selected type of sheet.

16. A non-transitory storage medium storing a program for controlling a computer of an image processing apparatus capable of printing an image on a sheet and controlling one of a plurality of binding units to bind the sheets, the plurality of binding units being configured to perform a respective plurality of types of binding processes, the program controlling the computer to:

control a reading unit to read an image of a document;

control a printing unit to print the image on a sheet;

control one of the plurality of binding units to bind sheets on which images are printed by the printing unit; and select a sheet to be used for printing that has the greatest quantity that can be bound by the designated binding process from a plurality of different types of sheets having the same size, wherein the image is printed on the selected sheet.

* * * * *